US007203435B2

(12) United States Patent
Ito et al.

(10) Patent No.: US 7,203,435 B2
(45) Date of Patent: Apr. 10, 2007

(54) IMAGE FORMING APPARATUS AND PRINTER HAVING A DOUBLE-SIDED PRINTING MODE

(75) Inventors: Mitsuhiro Ito, Shizuoka (JP); Hiroaki Sakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/377,374

(22) Filed: Mar. 17, 2006

(65) Prior Publication Data

US 2006/0177233 A1 Aug. 10, 2006

Related U.S. Application Data

(62) Division of application No. 10/982,808, filed on Nov. 8, 2004, now Pat. No. 7,016,619, which is a division of application No. 10/609,469, filed on Jul. 1, 2003, now Pat. No. 6,898,385.

(30) Foreign Application Priority Data

Jul. 5, 2002 (JP) ..... 2002-197743
Jul. 12, 2002 (JP) ..... 2002-204877

(51) Int. Cl.
*G03G 15/02* (2006.01)

(52) U.S. Cl. ..... 399/50; 399/82; 399/364

(58) Field of Classification Search ..... 399/50, 399/45, 43, 16, 46, 82, 364, 401
See application file for complete search history.

(56) References Cited

U.S. PATENT DOCUMENTS

| | | | | |
|---|---|---|---|---|
| 5,450,180 | A | 9/1995 | Ohzeki et al. | 399/50 |
| 5,717,979 | A | 2/1998 | Senba et al. | 399/50 |
| 5,835,818 | A | 11/1998 | Hoshika et al. | 399/26 |
| 5,845,172 | A | 12/1998 | Saito et al. | 399/50 |
| 5,970,302 | A | 10/1999 | Yamane | 399/50 |
| 6,081,679 | A | 6/2000 | Yamane et al. | 399/50 |
| 6,266,151 | B1 | 7/2001 | Tachibana et al. | 358/1.4 |
| 6,496,660 | B2 | 12/2002 | Takahashi et al. | 399/16 |
| 6,539,184 | B2 | 3/2003 | Shimura et al. | 399/50 |
| 6,806,895 | B2 | 10/2004 | Jeong | 399/45 |
| 2001/0026694 | A1 | 10/2001 | Sakaizawa et al. | 399/50 |
| 2002/0006289 | A1 | 1/2002 | Takami et al. | 399/50 |
| 2002/0159782 | A1 | 10/2002 | Tsuruya et al. | 399/50 |

FOREIGN PATENT DOCUMENTS

| | | |
|---|---|---|
| JP | 8-320642 | 12/1996 |

(Continued)

*Primary Examiner*—Sophia S. Chen
(74) *Attorney, Agent, or Firm*—Fitzpatrick, Cella, Harper & Scinto

(57) ABSTRACT

An image forming apparatus operating in a double-sided print mode, includes a charger for charging an image carrier, a charge voltage loader for applying a charge voltage to the charger, an image forming device for forming an image on a recording material, and a controller for controlling the charge voltage applied by the charge voltage loader to the charger. When an image is formed on both sides of a plurality of recording materials, the controller changes the charge voltage applied by the charge voltage loader from a first to a second voltage when an image is formed on first and second sides of the recording material in a period in which an image is formed on the recording sheet, and does not change the charge voltage during an interval between a first recording material and a second recording material to the second charge voltage.

8 Claims, 58 Drawing Sheets

FOREIGN PATENT DOCUMENTS

| | | |
|---|---|---|
| JP | 10-39691 | 2/1998 |
| JP | 2001-88370 | 4/2001 |
| JP | 2001-88406 | 4/2001 |
| JP | 2001-192132 | 7/2001 |
| JP | 2002-46876 | 2/2002 |
| JP | 2002-91102 | 3/2002 |

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | STANDBY FOR FEEDING | NULL |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.17A

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER FEEDING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17B

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17C

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER TRANSPORT FOR DOUBLE-SIDED PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17D

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17E

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER PRINTING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17F

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER PRINTING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17G

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER TRANSPORT FOR DOUBLE-SIDED PRINTING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.17H

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER FEEDING | NULL |
| 0 (VOID) | YET DECIDED | YET DECIDED | YET DECIDED | YET DECIDED | YET DECIDED | YET DECIDED |

FIG.17I

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER PRINTING | NULL |
| 0 (VOID) | YET DECIDED | YET DECIDED | YET DECIDED | YET DECIDED | YET DECIDED | YET DECIDED |

FIG.17J

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.17K

| FIG.19A | FIG.19B |
|---|---|

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | STANDBY FOR FEEDING | NULL |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.20A

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER FEEDING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20B

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20C

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER TRANSPORT FOR DOUBLE-SIDED PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20D

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20E

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER PRINTING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20F

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER PRINTING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.20G

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER TRANSPORT FOR DOUBLE-SIDED PRINTING | NULL |
| 4 | 7 | TURN-OVER UNIT | OUTPUT TRAY | A4 | STANDBY FOR FEEDING | PROHIBIT PRELIMINARY PAPER FEEDING |
| 0 (VOID) | YET DECIDED | YET DECIDED | YET DECIDED | YET DECIDED | YET DECIDED | YET DECIDED |

FIG.20H

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER FEEDING | NULL |
| 0 (VOID) | YET DECIDED | YET DECIDED | YET DECIDED | YET DECIDED | YET DECIDED | YET DECIDED |

FIG.20I

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER PRINTING | NULL |
| 0 (VOID) | YET DECIDED | YET DECIDED | YET DECIDED | YET DECIDED | YET DECIDED | YET DECIDED |

FIG.20J

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.20K

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | STANDBY FOR FEEDING | NULL |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.22A

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER FEEDING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22B

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | STANDBY FOR FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22C

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | UNDER TRANSPORT FOR DOUBLE-SIDED PRINTING | NULL |
| 2 | 4 | TURN-OVER UNIT | OUTPUT TRAY | A4 | STANDBY FOR FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22D

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER FEEDING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22E

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 1 | 4 | TOP CASSETTE | TURN-OVER UNIT | A4 | SECOND SIDE UNDER PROCESSING | NULL |
| 2 | 4 | TURN-OVER UNIT | OUTPUT TRAY | A4 | UNDER PRINTING | NULL |
| 3 | 7 | TOP CASSETTE | TURN-OVER UNIT | A4 | UNDER FEEDING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22F

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER PRINTING | NULL |
| 4 | 7 | TURN-OVER UNIT | OUTPUT TRAY | A4 | STANDBY FOR FEEDING | NULL |
| 0 (VOID) | YET DECIDED | YET DECIDED | YET DECIDED | YET DECIDED | YET DECIDED | YET DECIDED |

FIG.22G

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER TRANSPORT FOR DOUBLE-SIDED PRINTING | NULL |
| 4 | 7 | TURN-OVER UNIT | OUTPUT TRAY | A4 | STANDBY FOR FEEDING | PROHIBIT PRELIMINARY PAPER FEEDING |
| 0 (VOID) | YET DECIDED | YET DECIDED | YET DECIDED | YET DECIDED | YET DECIDED | YET DECIDED |

FIG.22H

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | UNDER TRANSPORT FOR DOUBLE-SIDED PRINTING | NULL |
| 4 | 7 | TURN-OVER UNIT | OUTPUT TRAY | A4 | STANDBY FOR FEEDING | PROHIBIT PRELIMINARY PAPER FEEDING |
| 5 | 14 | DOWN CASSETTE | OUTPUT TRAY | A4 | STANDBY FOR FEEDING | PROHIBIT PRELIMINARY PAPER FEEDING |

FIG.22I

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER FEEDING | NULL |
| 5 | 14 | DOWN CASSETTE | OUTPUT TRAY | A4 | UNDER FEEDING | NULL |

FIG.22J

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 3 | 7 | TOP CASSETTE | TURN-OVER UNIT | A4 | SECOND SIDE UNDER PROCESSING | NULL |
| 4 | 7 | TURN-OVER UNIT | OUTPUT TRAY | A4 | UNDER PRINTING | NULL |
| 5 | 14 | DOWN CASSETTE | OUTPUT TRAY | A4 | UNDER FEEDING | NULL |

FIG.22K

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 5 | 14 | DOWN CASSETTE | OUTPUT TRAY | A4 | UNDER PRINTING | NULL |

FIG.22L

| | PRINT CONDITION | | | MONITOR INFORMATION | | |
|---|---|---|---|---|---|---|
| ORDER OF PRINTING | ID NO. | PAPER INPUT PORT | PAPER OUTPUT PORT | PAPER SIZE | CONDITION OF PRINTER | ERROR OF PRINTER |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |
| 0 (VOID) | YET DECIDED | YET DECIDED | YET DECIDED | YET DECIDED | YET DECIDED | YET DECIDED |

FIG.22M

| FIG.24A | FIG.24B |
|---|---|

IMAGE FORMING APPARATUS AND PRINTER HAVING A DOUBLE-SIDED PRINTING MODE

This application claims the priority of Japanese Patent Application Nos. 2002-197743 filed Jul. 5, 2002 and 2002-204877 filed Jul. 12, 2002, which are incorporated hereinto by reference.

This is a divisional application of U.S. patent application Ser. No. 10/982,808, filed Nov. 8, 2004, and allowed Nov. 21, 2005 now U.S. Pat. No. 7,016,619, which is a divisional application of U.S. patent application Ser. No. 10/609,469, filed Jul. 1, 2003, now U.S. Pat. No. 6,898,385, the entire contents of each of which are incorporated herein by reference.

BACKGROUND OF THE INVENTION

1. Field of the Invention

The present invention relates to an electro-photographic image forming apparatus. More particularly, the invention relates to an image forming apparatus for forming images by the electro-photographic process using copiers and printers.

2. Description of the Related Art

Many electrographic copiers and printers form images on one side of a recording material such as recording paper. Now, however, what is called the double-sided image forming apparatus, which is capable of forming images on both sides of a sheet for environmental protection and savings of natural resources, has been commercialized. The double-sided image forming apparatus prints images on a first side and then on the other side, utilizing a paper turn-over mechanism that turns over 564 the sheet of which one side has been printed and a re-feeder mechanism that feeds the sheet again.

FIG. 1 is a diagram illustrating an example of the structure of the prior art electro-photographic laser beam printer. This laser beam printer has a sheet turn-over unit and a re-feeder unit near the center of the printer 100, and has a detachable transfer unit D for double-sided printing in the body. A paper cassette 101 that houses sheets of paper P is located at the bottom of the body. Sheets P are transported by a transport roller 108 to a process cartridge 112 via a pickup roller 104, a feeder roller 105 and a retard roller 106 that feed paper, separating sheets P one by one. Upstream of the process cartridge 112 are a pre-resist sensor 110 that detects the sheets P and resist rollers 109 that transport the sheets P synchronously.

The process cartridge 112 is detachably attached to the body and forms an electrostatic latent image with laser light from a scanner 111 on a photosensitive drum 1 working as the image carrier. A visible image or toner image is produced by developing this latent image. The scanner 111 is generally comprised of a laser unit 129 that emits laser light, a polygon mirror 130 that scans the laser light from the laser unit 129 on the photosensitive drum 1, a polygon motor 131, an image formation lens assembly 132 and a return mirror 133. The process cartridge 112 is equipped with the photosensitive drum 1, a charger 2, a developer 134 and a cleaner 6 that are all needed in common electro-photography.

Conventionally, the charger 2 is usually a non-contact type corona charger that charges the photosensitive drum 1 surface by providing corona produced by high-voltage applied to a thin corona discharge wire. In recent years, however, contact-type chargers have been most preferably used because of their advantages of lower pressure process, less ozone emission and lower cost. This is a method of, for example, contacting a roller charger material (hereinafter, a roller charger) to the surface of the photosensitive drum 1 and charging the photosensitive drum 1 by applying voltage to this roller charger 2. Although voltage applied to the roller charger 2 may be DC voltage alone, charging becomes uniform if AC voltage is additionally applied to repeat a plus/minus discharge alternatively. By exposing the uniformly charged photosensitive drum 1 to laser light using the scanner 111, the desired latent image is formed thereon and this latent image is transformed into a toner image by the developer 134.

A development bias is applied to the development roller constituting the developer 134. As the bias voltage for development, only DC voltage is applied when the development roller 134 contacts the photosensitive drum 1, while AC voltage is added to DC voltage during non-contact operation. The toner image on the photosensitive drum 1 is transferred to a sheet P by a transfer roller 113.

Downstream of the process cartridge 112 a fixer F affixes the toner image transferred to a sheet P by applying heat and pressure thereto. The fixer F is generally comprised of a fixer roller 117, a heater 116 that heats the fixer roller 117, a pressure roller 118 and a temperature sensor 140, such as a thermistor. The pressure roller 118 is pressed against the fixer roller 117 by a spring unit (not shown). Downstream of the fixer F are fixer exit rollers 139 and a fixer unit sensor 119 that detects the passage of a sheet P.

Downstream of the fixer exit rollers 139, the transport path is branched and a flapper 120 decides the way of paper transport. In usual single-sided printing, a sheet P is conveyed to the outside of the body by the output rollers 122, while for double-sided printing it is sent to the transport unit D.

The transport unit D for double-sided printing has a sheet turn-over unit equipped with reverse rollers 123 and a reverse sensor 124, and a re-feeder unit equipped with a D-cut roller 125, a sensor 126 and transport rollers 127.

The transport path is branched upstream of the reverse rollers 123, and the reverse sensor 124 is installed near the branching point. A sheet P is stopped in the position where the end of the sheet P has traveled a prescribed distance passing the reverse sensor 124, and then sent to the re-feeder unit by reverse rotation of the reverse rollers 123.

When the turn-over unit sensor 126 has detected the passage of the sheet P, the transport rollers 127 convey sheet P to the transport roller 108 again for re-feeding. Later, the sheet P passes the resist rollers 109 again, and the transfer roller 113 conducts image formation on the other side of the sheet P. Then the sheet P is guided by the flapper 120 to output rollers 122 for output after toner is fixed by the fixer F.

In this type of image forming apparatus, the number of sheets waiting in the transport path in the sheet turn-over mechanism and re-feeder mechanism is determined according to sheet sizes, and their printing sequence is optimized for efficient double-sided printing (for example, as discussed in Japanese Patent Application Laid-open No. 2002-091102). If a large number of sheets are to be printed double-sided, their printing sequence is changed so that the number of sheets waiting in the transport path in the sheet turn-over mechanism and re-feeder mechanism is maximized according to sheet sizes. Such changes of printing sequence are conducted by altering the page sequence based on printing information that is sent from a PC, for example, and stored in the memory of the printer.

However, when the memory capacity in the printer is small, it cannot hold the printing information of many pages and thus the printing sequence cannot be changed. When the memory capacity is small, the sheet is turned over after its first side is printed and then re-fed for printing on the other side (rear face). Each of two or more sheets is printed in this manner. Then, instead of plural sheets, only one sheet is held in the transport path of the sheet turn-over mechanism and the re-feeder mechanism.

Regardless of memory capacity, when only one sheet is printed double-sided, the sheet is turned over after one side is printed and re-fed for printing on the other side (rear face). In addition, when a double-sided copy is made by scanning a document with a scanner, printing is done while the document is being scanned. Since the page sequence cannot be changed in this case, it is repeated in many cases to turn over the sheet after one side is printed and then re-feed it for printing on the other side, when two or more document pages are scanned for double-sided copying.

When the sheet is turned over after one side is printed and then re-fed for printing on the other side and therefore the transport path in the sheet turn-over mechanism and the re-feeder mechanism holds only one sheet at a time, it takes time to turn over and re-feed the paper. Then the power to the charger for the electro-photographic process is suspended, or the heater for fixing is deactivated to prevent the image carrier from wearing and unnecessary heater operation (for example, as discussed in Japanese Patent Application Laid-open No. 8-320642).

However, in such a double-sided image forming apparatus, there will be a significant difference in the rotation time of the photosensitive drum per sheet between continuous double-sided printing and double-sided printing on only one sheet.

FIG. 2 is a timing chart for continuous double-sided printing in the prior art image forming apparatus, and it illustrates the timing for continuous 4-sheet double-sided printing. FIG. 3 is a timing chart for one-sheet double-sided printing in the prior art image forming apparatus.

In general, after AC voltage and DC voltage for charging are raised to prescribed values, DC high-voltage is applied as the bias voltage for development in the pre-rotation process, and then AC high-voltage is applied in the printing process as the bias voltage for development. Transfer high-voltage is applied when a sheet P passes the transfer unit. During the interval of sheet printing, the AC high-voltage for development is lowered and the transfer high-voltage is also lowered to a level for the interval. When the last page is printed, the post-rotation process starts, and the transfer high-voltage, DC high-voltage for development, DC high-voltage for charging and AC high-voltage for charging are lowered in this order.

In FIG. 2, when a first side of the first sheet is printed and the sheet has reached the turn-over point, a first side of the second sheet is printed. When the first sheet has reached the transport unit in the turn-over unit and the second sheet has reached the turn-over point, a first side of the third sheet is printed, and then the second side of the first sheet, a first side of the fourth sheet and the second side of the second sheet are printed sequentially. When the second side of the third sheet and the second side of the fourth sheet are printed in a row, the double-sided printing on four sheets is over.

Referring now to FIG. 2, because printing is completed in a short time in continuous double-sided printing, the interval period of time per sheet does not much affect the life of the photosensitive drum 1. The life is as long as that of the drum used in continuous single-sided printing.

On the other hand, when double-sided printing is repeated for each single sheet, the steps of printing on a first side, paper interval, and printing on the second side are repeated, as shown in FIG. 3. Such operation is seen when the memory does not have a capacity large enough to store the image data of plural pages or when an image forming apparatus equipped with a read scanner conducts double-sided copying. During the time interval between printing on a first side and printing on the other side, namely, the period of time from the turn-over of a sheet P to its re-feeding, the photosensitive drum 1 keeps rotation. Because usually it takes as much time as printing two or three pages to turn over sheet P and re-feed it, the life of the photosensitive drum 1 becomes equally shorter.

Image forming apparatuses are expected to run faster and faster. Thus if the next feed process is started after the feeding of each previous sheet is completed, the feeding speed itself must be raised. Otherwise, even if the feeding speed is raised, there will be a limit to throughput.

To solve such problems, printing data is stored in a printing data reservation memory, and as soon as the printing requirements are met paper is fed for printing based on the data stored in the memory, in order to feed not only the next sheet but also further latter sheets at a time (hereinafter, preliminary feeding; for example, as discussed in Japanese Patent Application Laid-open Nos. 2002-046876, 2001-192132, 2001-088406 and 2001-088370). By virtue of this improvement, throughput can be easily maximized without raising the paper feeding speed too much or raising print cost, even when the transport path for recording sheets is rather long.

In many printers, a single driving source (motor) is used to rotate the image carrier and transport rollers for lower cost. The motor is directly connected to the driver of the image carrier, while its connection to transport rollers is switched by a clutch. In the image forming apparatus of such structure, the sheet is turned over after its first side is printed and then re-fed for printing on the other side. Then a single sheet is held for double-sided printing in the transport path in the sheet turn-over mechanism and the re-feeder mechanism. If the abovementioned preliminary feeding is adopted in this system to maximize throughput, the following problems arise.

If a single sheet is to be printed double-sided, it is possible to stop the rotation of the image carrier by suspending high-voltage for electro-photography while the one-side printed sheet is turned over and fed again. However, in the case of continuous double-sided printing of plural sheets, the transport rollers must be kept rotating for preliminary feeding of the subsequent sheets, while the one-side printed sheet is turned over and fed again. Since the image carrier shares the driving source with the transport rollers, its rotation cannot be stopped during preliminary feeding.

As a result, throughput can be maximized with no increased cost, but such a problem results that the image carrier wears fast and comes to the end of its life early because it keeps rotating and receives a high-voltage while the one-side printed sheet is turned over and re-fed.

In cases other than double-sided printing, a similar problem will arise when the paper interval is long in usual single-sided printing.

SUMMARY OF THE INVENTION

The present invention has been made to solve such problems, and provides an image forming apparatus where the life of the image carrier does not become significantly short even when the distance between individual sheets is rather long.

Another object of the invention is to provide an image forming apparatus that can extend the life of the image carrier while maintaining maximized throughput.

To attain these objects, forming an electrostatic latent image on an image carrier, in one aspect of the present invention an image forming apparatus includes: a charging unit for charging the image carrier; a charge voltage loading unit for applying charge voltage to the charging unit; an exposure unit for exposing the image carrier charged by the charging unit to form an electrostatic latent image corresponding to image signals; a development unit for forming a toner image by developing the electrostatic latent image formed on the image carrier by the image carrier; an image transfer unit for continuously transferring the toner image formed by the development unit onto a plurality of recording materials; and a control unit for controlling AC charge voltage applied by the charge voltage loading unit to the charging unit, wherein, when the transport interval of the plural recording materials is shorter than a predetermined time the AC charge voltage applied to the image carrier during the transport interval is a first AC charge voltage, and when the transport interval is longer than the predetermined time the AC charge voltage applied to the image carrier during the transport interval is a second AC charge voltage, the control unit makes the current running in the charging unit to which the second AC charge voltage is applied lower than the current running in the charging unit to which the first AC charge voltage is applied.

In another aspect, the image forming apparatus that forms an electrostatic latent image on an image carrier includes: a charging unit for charging the image carrier; a charge voltage loading unit for applying charge voltage to the charging unit; an exposure unit for exposing the image carrier charged by the charging unit and forming an electrostatic latent image corresponding to image signals; a development unit for forming a toner image by developing the electrostatic latent image formed on the image carrier by the image carrier; an image transfer unit for continuously transferring the toner image formed by the development unit onto a plurality of recording materials; a fixer unit for fixing the toner image transferred by the image transfer unit to the recording material; a transport unit for transporting the recording material to the image transfer unit to transfer a toner image onto the other side of the recording material where a toner image has been fixed by the fixer unit; and a control unit for controlling AC charge voltage applied by the charge voltage loading unit to the charging unit. While the transport unit is not transporting the recording material the AC charge voltage is a first AC charge voltage, and while the transport unit is transporting the recording material the AC charge voltage is a second AC charge voltage, and the control unit makes the current running in the charging unit to which the second AC charge voltage is applied lower than the current running in the charging unit to which the first AC charge voltage is applied.

In another aspect, the image forming apparatus that forms an electrostatic latent image on an image carrier includes: a charging unit for charging the image carrier; a charge voltage loading unit for applying charge voltage to the charging unit; an exposure unit for exposing the image carrier charged by the charging unit and forming an electrostatic latent image corresponding to image signals; a development unit for forming a toner image by developing the electrostatic latent image formed on the image carrier by the image carrier; an image transfer unit for continuously transferring the toner image formed by the development unit onto a plurality of recording materials; a fixer unit for fixing the toner image transferred by the image transfer unit to the recording material; a feeder unit for feeding the recording material from a recording material container where a plurality of recording materials are loaded; a transport unit for transporting the recording material to the image transfer unit to transfer a toner image onto the other side of the recording material where a toner image has been fixed by the fixer unit; a control unit for controlling AC charge voltage applied by the charge voltage loading unit to the charging unit; and a memory unit for storing the image formation conditions about the plural recording materials based on the command sent from an external device. While the transport unit is not transporting the recording material, the AC charge voltage is a first AC charge voltage, while the transport unit is transporting the recording material and the feeder unit is feeding the recording material subsequent to said recording material based on the image formation conditions stored in the memory unit, the AC charge voltage is a second AC charge voltage, and the control unit makes the current running in the charging unit to which the second AC charge voltage is applied lower than the current running in the charging unit to which the first AC charge voltage is applied.

According to the above configurations, it becomes possible to prevent the image carrier from wearing by an optimized control based on individual print conditions such that only a single side is printed, alternative double-sided print holding plural sheets in a standby status in the turn-over unit, and double-sided printing is conducted while only one sheet is held in the turn-over unit.

According to the above configurations, it becomes possible to prevent the image carrier from wearing while minimizing the decrease in throughput by conducting preliminary paper feeding upon the resumption of image carrier rotation even when a print reservation is made during the period while the paper is under transport for double-sided printing and the rotation of the image carrier is suspended.

According to the present invention related with an image forming apparatus that charges the image carrier by contacting a voltage-loaded charging material thereto, it becomes possible to reduce the wear of the image carrier and thereby significantly extend its useful life by lowering AC voltage or AC current applied to the charging unit when it is known in advance that the paper interval during continuous printing becomes longer than usual.

Furthermore, if any subsequent print job is reserved, the preliminary feeding of paper is conducted for the reserved job during the time while the first sheet is turned over and transported to the position of re-feeding for double-sided printing in the interval between printing on its first side and printing on the other side to maximize throughput with no rise in cost. No preliminary paper feeding becomes necessary when no subsequent print job is reserved when the first sheet is turned over and transported to the position of re-feeding for double-sided printing in the interval between printing on its first side and printing on the other side. Thus, during this period, both DC and AC voltages are terminated and the rotation of the photosensitive drum is suspended to further reduce the wear of the photosensitive drum. As a result, the throughput is maintained high with no rise in cost, and the wear of the photosensitive drum is prevented in the optimized manner by controlling the drum rotation and voltage output for charging corresponding to individual conditions for double-sided printing. In addition, energy saving effects are provided by eliminating unnecessary drum operation and charging power.

The above and other objects, effects, features and advantages of the present invention will become more apparent from the following description of embodiments thereof taken in conjunction with the accompanying drawings.

BRIEF DESCRIPTION OF THE DRAWINGS

FIGS. 17A–17K are diagrams illustrating the print reservation tables for the image forming apparatus of the fourth embodiment;

FIGS. 20A–20K are diagrams illustrating the print reservation tables (double-sided printing on two pages) for the image forming apparatus of the fifth embodiment;

FIGS. 22A–22M are diagrams illustrating the print reservation tables (double-sided printing on two pages plus single-sided printing) for the image forming apparatus of the fifth embodiment;

DETAILED DESCRIPTION OF PREFERRED EMBODIMENTS

Now the preferred embodiments of the present invention will be described with reference to the accompanying drawings.

Emodiment 1

Figure 4:
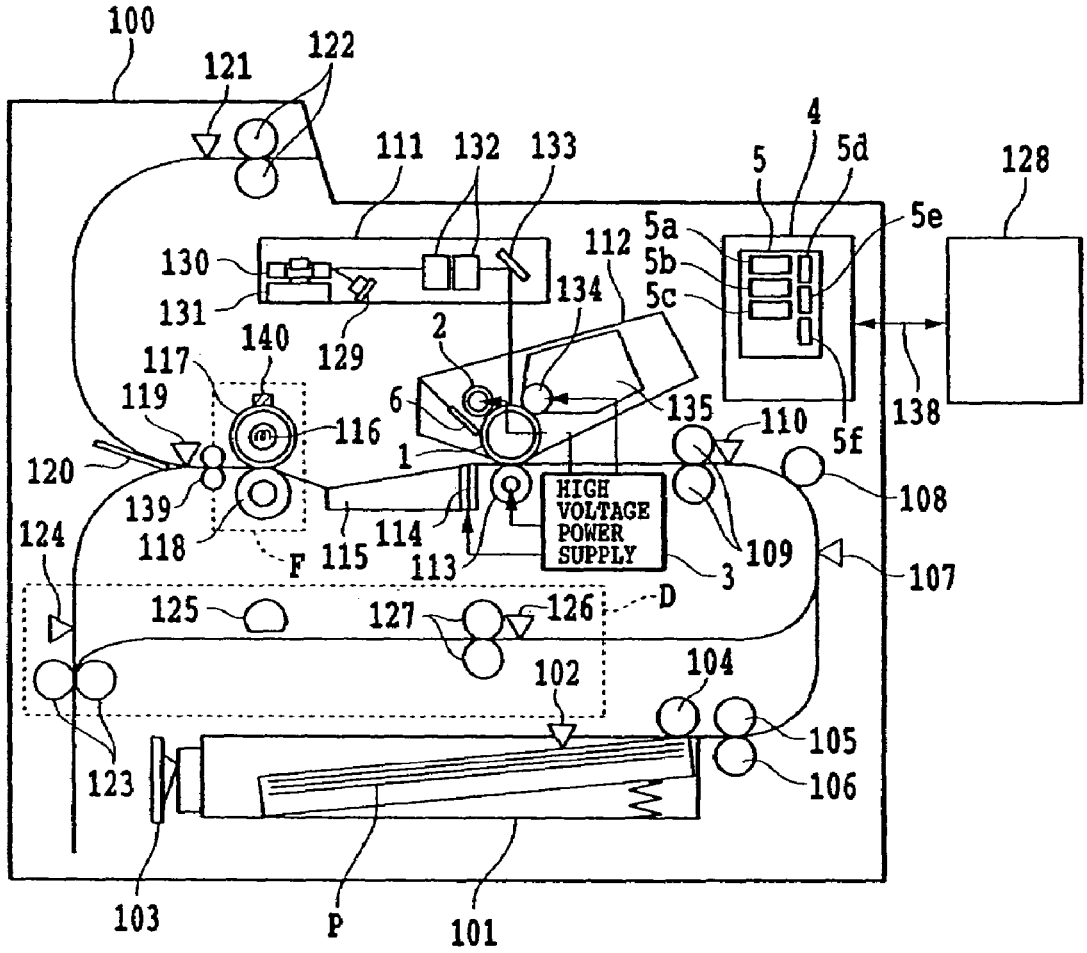
FIG. 4 is a schematic structure of the image forming apparatus of a first embodiment of the invention.

FIG. 4 is a schematic structure of a laser beam printer that is an embodiment of the image forming apparatus of the invention.

The laser beam printer 100 of this embodiment has a paper cassette 101 holding recording material, namely, recording paper P, a paper cassette paper detection sensor 102 that detects the presence/absence of recording paper P in the paper cassette 101, a paper size sensor 103 that detects the size of recording paper P in the paper cassette 101, a pickup roller 104 that picks up recording paper P from the paper cassette 101, a transport roller 105 that conveys recording paper P picked up by the pickup roller 104, and a retard roller 106 that is paired with the transport roller 105 and prevents recording paper P from being conveyed in a stack.

Downstream of the feeder roller 105 are a paper feeder sensor 107 that monitors the state of paper sheets transported from a turn-over unit D (to be described later), a paper transport roller 108 that conveys recording paper P further downstream, a pair of resist rollers 109 that convey recording paper P in synchronization, and a pre-resist sensor 110 that monitors the state of recording paper P transported to the resist roller pair 109.

Downstream of the resist roller pair 109 are a process cartridge 112 that forms a toner image on the photosensitive drum 1 by the use of laser light from a laser scanner 111 (to be described later), a transfer roller 113 that transfers the toner image formed on the photosensitive drum 1 onto the recording paper P, and a discharge unit 114 (hereinafter, discharge wire) that facilitates the charge removal from the recording paper P and thereby helps it leave the photosensitive drum 1.

Further downstream of the discharge wire 114 are a transport guide 115, a fixer unit F having a pressure roller 118 and a fixer roller 117 equipped therein with a halogen heater 116 for thermally affixing the toner image transferred to the recording paper P, fixer exit rollers 139, a fixer unit sensor 119 that monitors the state of paper sheets transported from fixer unit F, and a flapper 120 that switches the path of recording paper P sent from fixer unit F to either an output unit or the turn-over unit D for double-sided printing. Downstream on the output side, a paper output sensor 121 that monitors the state of paper sheets sent to the output unit and a pair of output rollers 122 for ejecting recording paper are installed.

The turn-over unit D for double-sided printing turns over the recording paper P, of which either side has been printed, for printing on the other side, and sends it to the image forming unit again. This turn-over unit D has a pair of reverse rollers 123 that switch back the recording paper P by rotating in forward/reverse directions, a reverse sensor 124 that monitors the state of the recording paper P transported to the reverse roller pair 123, a D-cut roller 125 that transports recording paper P from a transverse resist unit (not shown) that aligns recording paper P in the transverse direction, a turn-over unit sensor 126 that monitors the state of recording paper P in turn-over unit D for double-sided printing, and a pair of transport rollers 127 in turn-over unit that transport recording paper P from turn-over unit D to the feeder unit.

The scanner 111 has a laser unit 129 that emits laser light modulated by image signals sent from an external device 128 (to be described later), a polygon mirror 130 and a scanner motor 131 for scanning laser light of the laser unit 129 on the photosensitive drum 1, an image formation lens assembly 132, and a return mirror 133.

The process cartridge 112 has a photosensitive drum 1 needed for common electro-photography, a charging roller 2 working as a charger, a development roller 134 and a toner cassette 135 that work as a developer, and a cleaning blade 6 that is a cleaning unit. The process cartridge is attached to the laser printer 100 detachably.

The laser beam printer 100 has a high-voltage power supply 3 and a printer controller 4. The high-voltage power supply 3 has a high-voltage output circuit for charging 30 (shown in FIG. 5) (to be described later), the developer roller 134, the transfer roller 113, and a high-voltage output circuit that supplies a desired voltage to the discharge wire 114.

The printer controller 4 that controls the laser beam printer 100 has a CPU 5 equipped with a RAM 5*a*, a ROM 5*b*, a timer 5*c*, a digital I/O port (hereinafter, I/O port) 5*d*, an analog-digital converter input port (hereinafter, A/D port) 5*e* and a digital-analog output port (hereinafter, D/A port) 5*f*, as well as input-output control circuits (not shown). The printer controller 4 is connected to the external device 128, such as a personal computer, via an interface 138.

Figure 5:
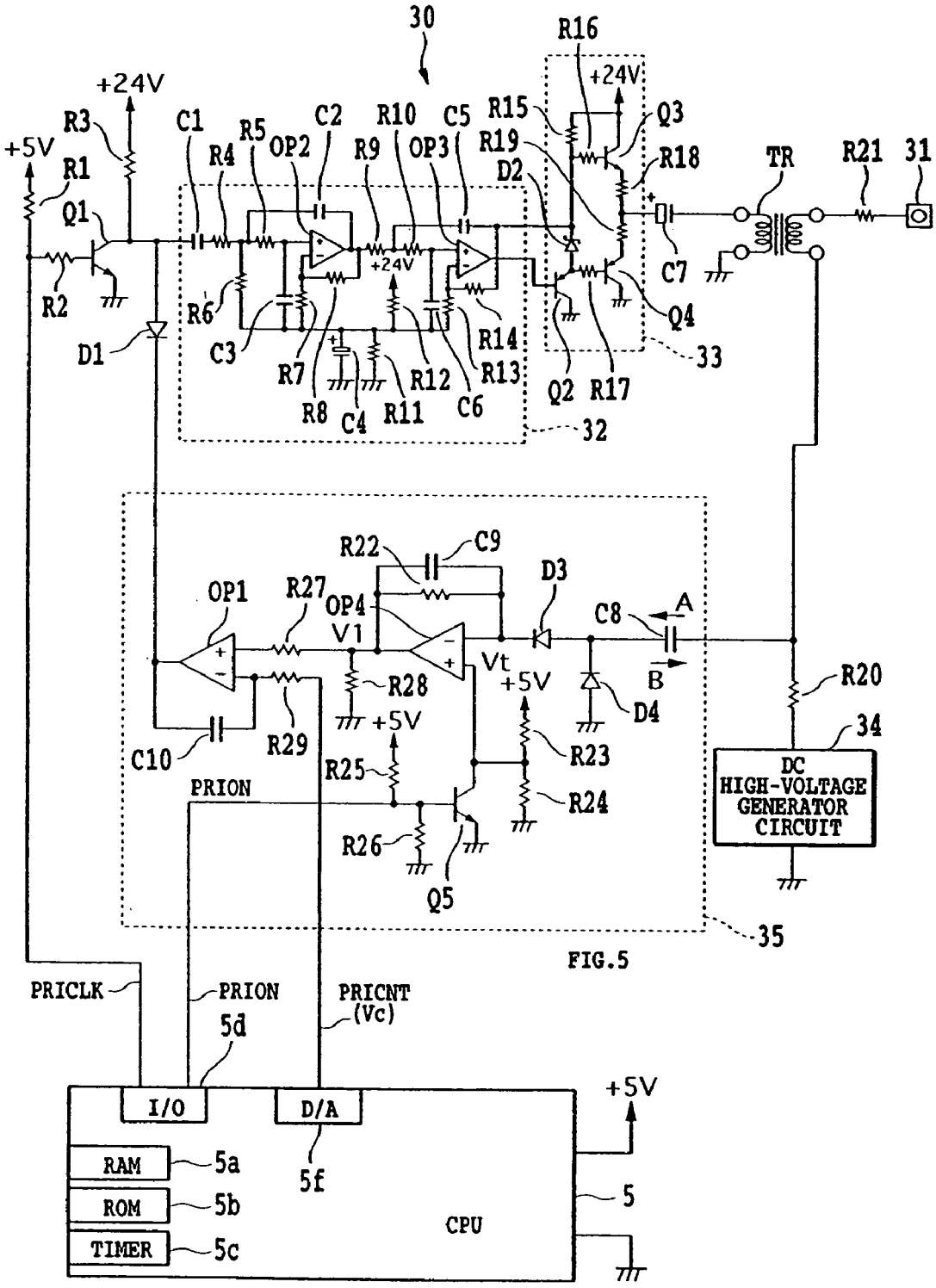
FIG. 5 is a diagram of an embodiment of the high-voltage output circuit for charging.

FIG. 5 is a diagram illustrating the structure of an embodiment of the charging high-voltage output circuit in the high-voltage power supply. The control of high-voltage output for charging by CPU 5 of the invention is explained with reference to this charging high-voltage output circuit 30.

The charging high-voltage output circuit 30 produces high-voltage for charging by overlapping charging AC high-voltage Vcac onto charging DC high-voltage Vcdc, and provides the output from the output terminal 31 of FIG. 5. The output terminal 31 is connected to the charging roller 2 that contacts the photosensitive drum 1.

When the I/O port 5*d* of CPU 5 provides clock pulses (PRICLK), a transistor Q1 switches via a pull-up resistor R1 and a base resistor R2, and the pulses are amplified to have amplitudes corresponding to the output of an operation amp OP1 connected to a pull-up resistor R3 via a diode D1. The operation amp OP1 is part of a current detection unit 35 and will be explained in detail later. When the amplitudes of clock pulses are large, the amplitudes of sinusoidal driving voltage waves (voltage from peak to peak) provided to a high-voltage transformer TR (to be described later) become also large. Thereby, voltage from peak to peak, indicating the level of charging AC high-voltage Vcac, is raised.

The clock pulses (PRICLK) are provided to the primary coil of high-voltage transformer TR via a filter circuit 32 and a high-voltage transformer driver circuit 33 of a push-pull type. Namely, the clock pulses(PRICLK) amplified by operation amp OP1 are sent to the filter circuit 32 via a capacitor C1, with the filter circuit 32 consisting of resistors R4–R14, capacitors C2–C6 and operation amps OP2, OP3 providing sinusoidal waves across +12V.

The output from the filter circuit 32 is entered to the primary coil of the high-voltage transformer TR via the push-pull type high-voltage transformer driver circuit 33, which includes a transistor Q2, a Zener diode D2, resistors R15–R19 and transistors Q3, Q4, and via a capacitor C7, to produce sinusoidal waves of charging AC high-voltage Vcac on the secondary coil side. One of the terminals of the secondary side of the high-voltage transformer TR is connected to a charging DC high-voltage generator circuit 34 via a resistor R20. Thus, the charging high-voltage V where charging AC high-voltage Vcac is overlapped on charging DC high-voltage Vcdc is provided from the output terminal 31 via an output protection resistor R21, and then supplied to the charging roller 2.

Next explained is the current detection unit 35 of the charging AC high-voltage circuit 30.

As described above, the charging AC current Iac produced by the charging AC high-voltage generator circuit 30 is provided to the current detection circuit, namely, the current detection unit 35. In this current detection unit 35, the charging AC current Iac from the charging AC high-voltage generator circuit 30 passes a capacitor C8, and the half-waves of direction A run through a diode D3, while the half-waves of direction B run through a diode D4. The half-waves of direction A that have passed the diode D3 are provided to an integral circuit composed of an operation amp OP4, a resistor R22 and a capacitor C9, and then converted into DC voltage. Additionally, a resistor R28 is provided.

Voltage at output (V1) in the operation amp OP4 is expressed by:

$$V132 - (Rs \times I\text{mean}) + Vt \qquad \text{(Eq. 1)}$$

where Imean is the mean of the charging AC current Iac half-waves, Rs the resistance of resistor R22, and Vt the voltage supplied to the positive input of operation amp OP4. This voltage Vt is a voltage provided by splitting an output (PRION) from the I/O port 5*d* of CPU 5 by resistors R25, R26, and thereafter, inputting it into a transistor Q5 so that the output of the transistor Q5 is split by resistors R23, R24.

The output from operation amp OP4 is connected to the positive input of operation amp OP1 for comparison with the level of a current control signal (PRICNT) at the minus input. The current control signal (PRICNT) is a signal used to set the current level of the charging AC current Iac.

If the output voltage (V1) from operation amp OP4 is larger than setting voltage (Vc) used to set by the current control signal (PRICNT), the output from operation amp OP1 grows. As explained previously, when the output from operation amp OP1 grows, the amplitudes of clock pulses provided to the filter circuit 32 also grow and thereby voltage from peak to peak of the charging AC high-voltage Vcac becomes large. Here, a capacitor C10 and a resistor R29 are provided for the operation amp OP1. In addition, a resistor R27 is provided to adjust an input resistance of the operation amp OP1.

Under such configuration, the peak to peak voltage of the charging AC high-voltage Vcac is controlled so that the charging AC current Iac has a value corresponding to the setting voltage Vc used to set by the current control signal (PRICNT). In other words, a constant current control is conducted according to the current control signal (PRICNT)

Figure 6:
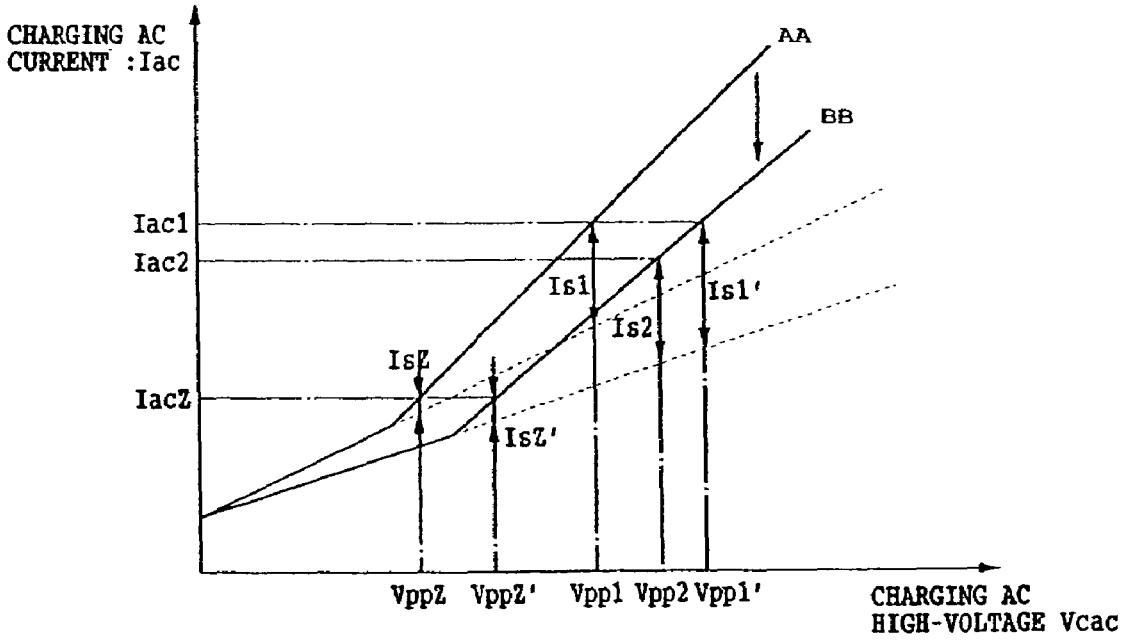
FIG. 6 is a characteristic chart of AC voltage for charging and charge current.
Figure 7:
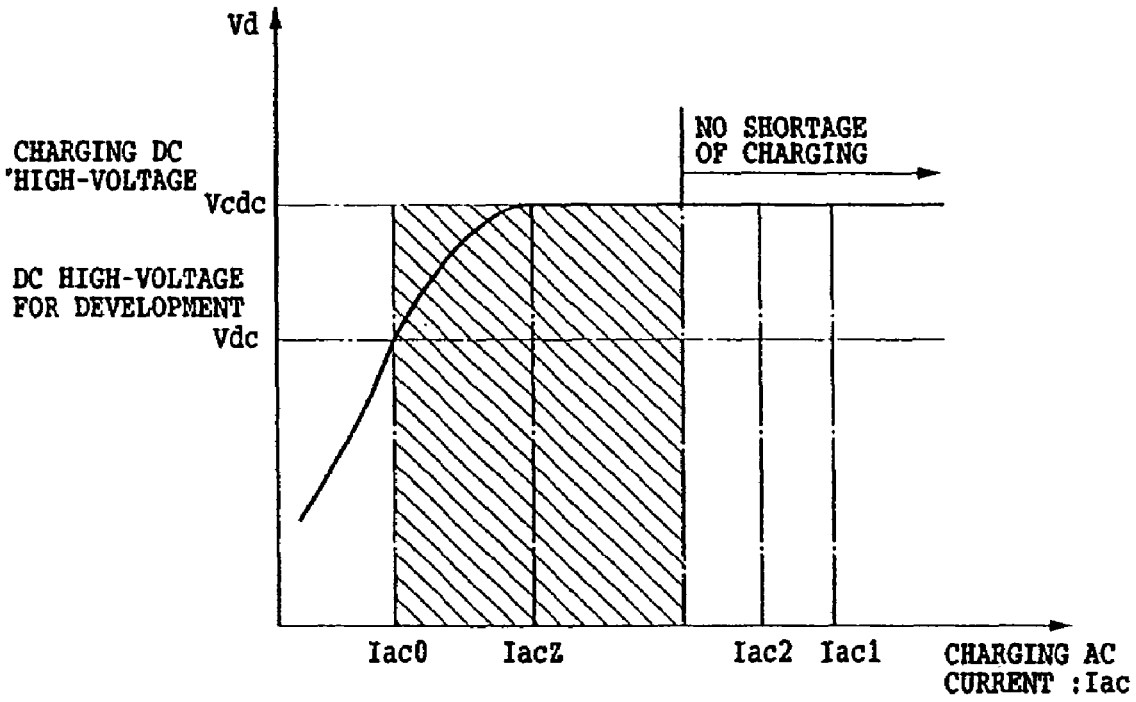
FIG. 7 is a characteristic chart of charge current and potential of the photosensitive drum.
Figure 8:
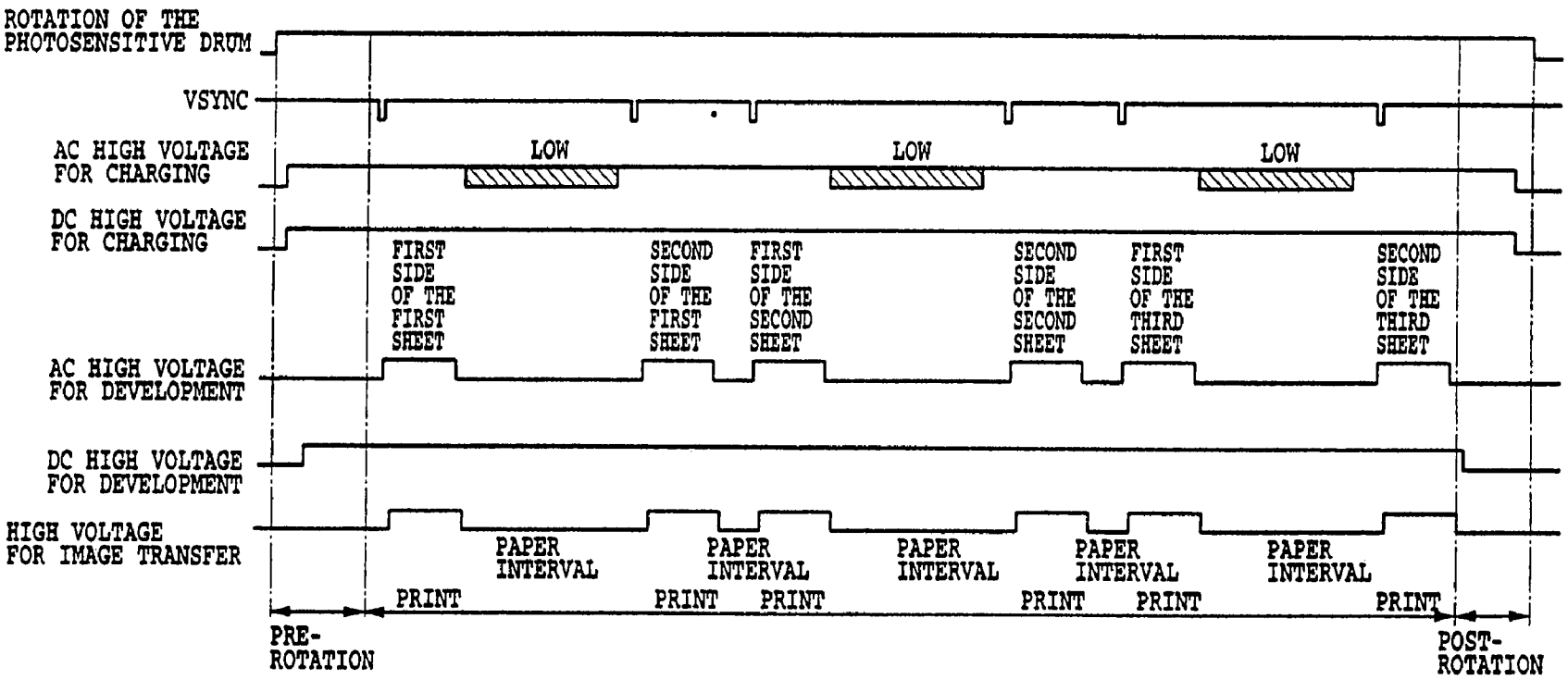
FIG. 8 is a timing chart for the image forming apparatus of the first embodiment.

FIGS. 6–8 are diagrams illustrating the charging control in this embodiment. FIG. 6 is a characteristic chart of the charging AC high-voltage Vcac and the charging current Iac.

FIG. 7 is a characteristic chart of the charging current Iac and the surface potential Vd of the photosensitive drum 1. FIG. 8 is a timing chart for the image forming apparatus.

In FIG. 6, graph AA shows the characteristics of early stages of the photosensitive drum 1, while graph BB shows the characteristic of the state of the photosensitive drum 1 after a lapse of significant time.

The charging AC current (Iac) running in the charging roller 2 steps up straightforwardly when the applied charging AC voltage Vcac of the charging roller 2 has low peaks, and the charging AC current (Iac) increases after passing a threshold for starting of discharge. Namely, the difference between the solid line and the broken line extrapolated from the straight line of the early-stage of the photosensitive drum 1 becomes a discharge current Is for charging. The constant current is controlled so that this discharge current Is for charging falls in a prescribed range. In general, when the discharge current Is for charging is low the image quality is impaired because of shortage of charging, while if the discharge current Is for charging is large then damage to the photosensitive drum 1 grows and it quickly wears.

In this embodiment, by setting the current control signal from the D/A port 5*f* to Vc1 at early stages of the photosensitive drum 1, the AC current Iac1 (applied AC voltage: Vpp1) as shown in FIG. 6 is held constant by the CPU 5 to provide a discharge current Is1. Meanwhile, when significant time has passed for the photosensitive drum 1, it shows the characteristics of graph BB. If the applied AC voltage Vpp1' is set so that the charge current Iac becomes Iac1, the discharge current of the early stage of the photosensitive drum 1 increases to Is1' from Is1, and damage to the photosensitive drum 1 also increases. As a result, after a predetermined time of use, the CPU 5 controls such that the discharge current is set to Is2 (>>Is1) by changing the current control signal from the D/A port 5*f* to Vc2 from Vc1 and the constant current (changing AC current) Iac to Iac2 (applied AC high-voltage Vcac>>Vpp2).

Now the relationship between the charge AC current Iac and the photosensitive drum potential V*d* is explained with reference to FIG. 7. When the current control signal (PRICNT) increases to the setting voltage Vc by CPU 5, the discharge current Is for charging also increases from an initial current IacO according to the characteristics shown in FIG. 6 and the potential Vd of the photosensitive drum 1 increases, approaching the charging DC high-voltage Vcdc applied to the charging roller 2. With the charge current Iac1 (Iac2) for setting the discharge AC current Is for changing at a prescribed value Is1 (Is2), the potential Vd of the photosensitive drum 1 is sufficiently stabilized and poor charging does not occur (region indicated by arrow as shown FIG. 7).

Figure 1:
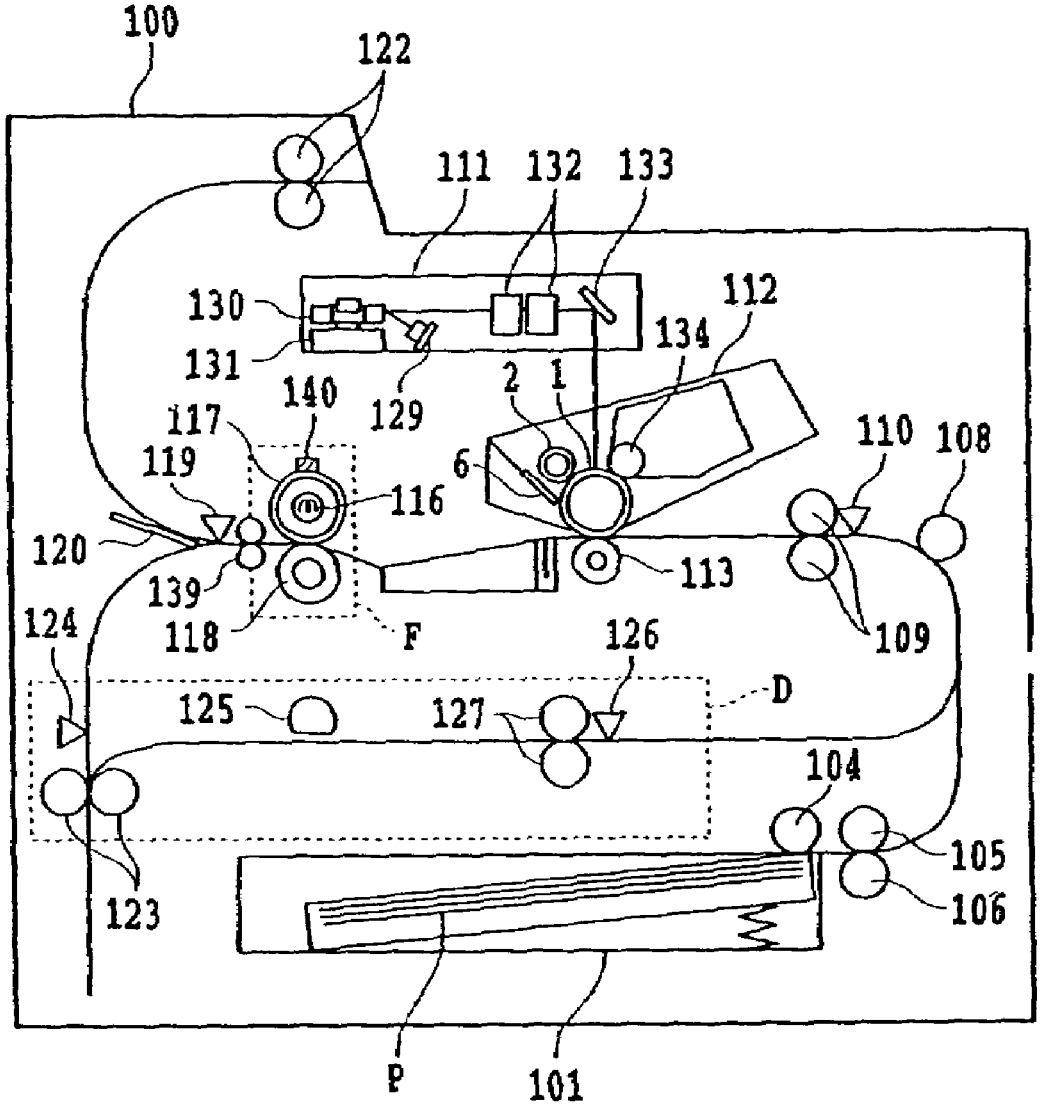
FIG.1 PRIOR ART
FIG. 1 is a schematic structure of the prior art image forming apparatus.
Figure 2:
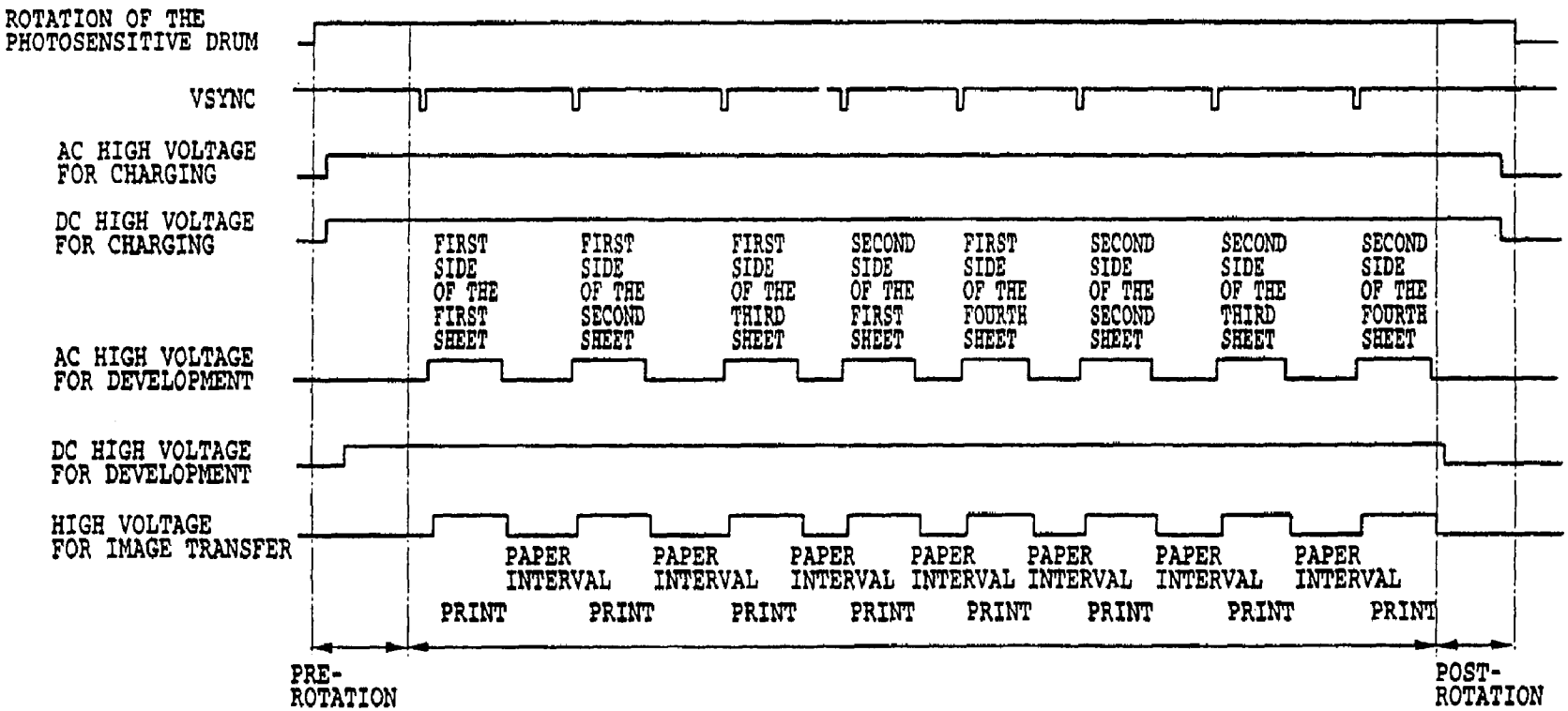
FIG.2 PRIOR ART
FIG. 2 is a timing chart for continuous double-sided printing in the prior art image forming apparatus.
Figure 3:
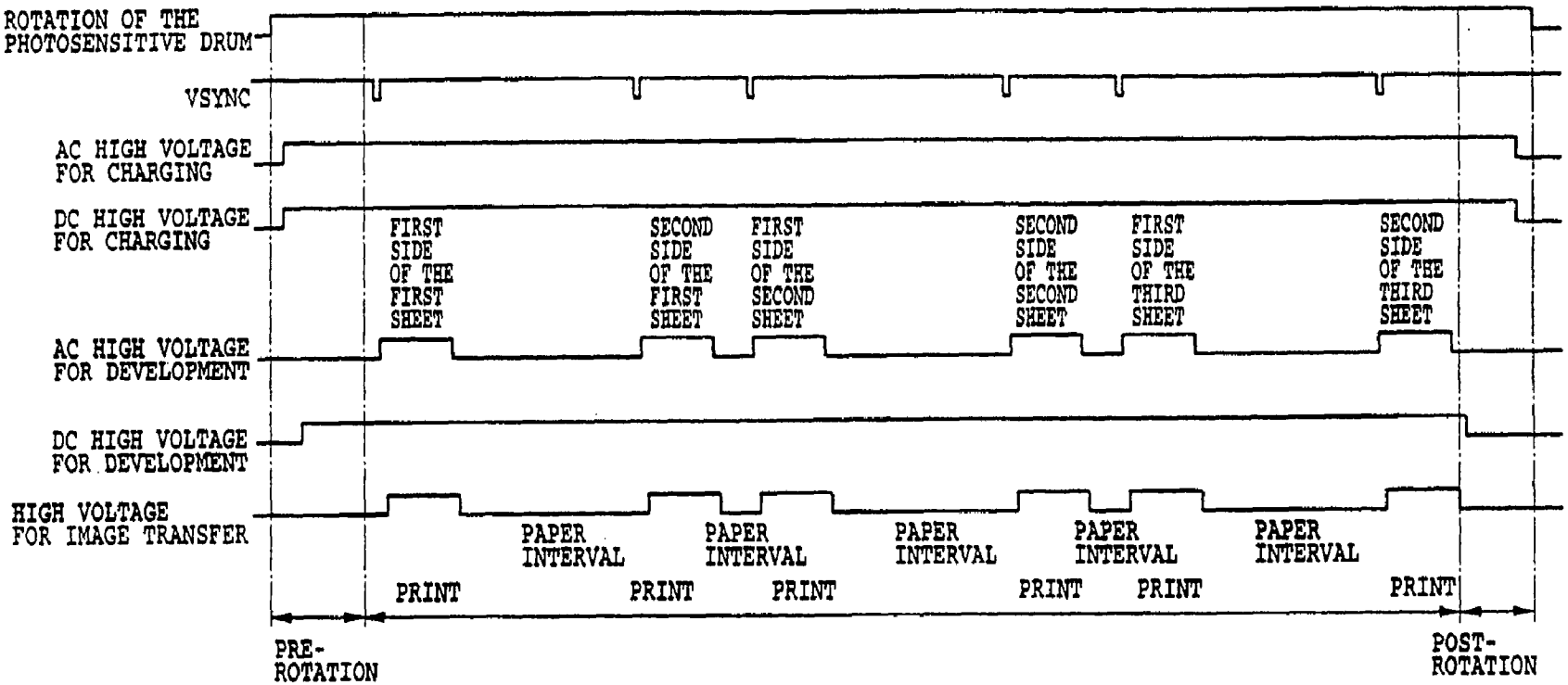
FIG.3 PRIOR ART
FIG. 3 is a timing chart for single-sheet double-sided printing in the prior art image forming apparatus.

Charging control by the CPU 5 conducted during double-sided printing of recording paper P is explained with reference to FIG. 8. Much like FIG. 3, FIG. 8 shows a timing chart for double-sided continuous printing to print either side and then print the other side on each of three recording papers P.

When it has been decided to print either side of the recording paper P and then print the other side of the recording paper P like this example, the charging AC high-voltage Vcac for charging is kept, while the period of time the sheet (hereinafter transporting for double-side printing) is printed one-sided, turned over and re-fed, at a value (hereinafter, LOW value) lower than that running during the printing process.

This LOW setting is a setting of voltage Vc in the current control signal (PRICNT) provided from the D/A port 5*f* of CPU 5 at a voltage VcZ which is lower than the voltage Vc1 adopted during printing by the photosensitive drum 1 onto the recording paper P. As described later, a predetermined time is needed from the time the voltage Vc in the charge current signal (PRICNT) is switched to the time the charge current Iac running in the charging roller 2 has stabilized at a constant value. Thus, during the step-down of charge voltage, the charge current Iac changes from Iac1 to IacZ after a predetermined time Tdn has passed since the CPU 5 switched voltage Vc in the current control signal (PRICNT) from Vc1 for printing (Vc2 after the photosensitive drum 1 has been used for a sufficiently long time) to VcZ for the LOW setting. Meanwhile, during the step-up of charge voltage, the charge current Iac changes from IacZ to Iac1 (Iac2 after the photosensitive drum 1 has been used for a sufficiently long time) after a predetermined time Tup has passed since CPU 5 switched voltage Vc in the current control signal (PRICNT) from VcZ for the LOW setting to voltage Vc1 for printing (Vc2 after the photosensitive drum 1 has been used for a sufficiently long time). Thus, from FIG. 6, at an early stage of the photosensitive drum 1, when charge current value Iac changes from Iac1 to IacZ (the charge AC voltage Vcac changes from Vpp1 to VppZ), a discharge current Is drops from Is1 to IsZ. After a significant lapse of time for the photosensitive drum 1, the charge current value Iac changes from Iac2 to IacZ (the charge AC voltage Vcac changes from Vpp2 to VppZ'), and there occurs a drop from Is2 to IsZ'.

This charging AC current Iacz at LOW value as shown in FIG. 7 (hatched area) is a current level that causes poor charging if adopted during printing and sufficiently lower than the charging AC currents Iac1 and Iac2 during printing.

Then the discharge current Is for early stages where the charging AC current Iac is IacZ and the discharge current Is running after a sufficient time of using the photosensitive drum 1 becomes IsZ and IsZ'. The discharge current Is becomes IsZ or IsZ', during printing. Since the difference in discharge current between IsZ and IsZ' is lower than that between Is1 and Is2 during printing, the discharge current Ic increases is reduced after a sufficient time of using the photosensitive drum 1, to reduce wear of the photosensitive drum 1.

Even when two or more values for constant current control can be set in the charging roller 2, the system structure and control sequence are simplified in the first embodiment by setting only one value for the AC voltage for charging during the interval during double-sided printing.

Meanwhile, by setting photosensitive drum potential Vd at a value larger than DC voltage Vdc for development, it becomes possible to prevent toner pick-up to the white areas of the photosensitive drum 1 and to avoid both contamination of the transfer roller 113 by toner and waste of toner. In other words, by setting (LOW value) the charging AC current Iac for paper interval (during double-sided printing) at a value in the hatched area of FIG. 7, such troubles can be avoided and wear of the photosensitive drum 1 can be reduced.

Furthermore in this embodiment, switching of the charging AC current Iac to the LOW value is carried out between the time the first side is printed and the time the paper is re-fed for printing on the second side, with reference to the vertical synchronization signal of image (VSYNC). This switching may be done based on the signals from the fixer unit sensor 119, the reverse sensor 124 in the turn-over unit and the turn-over unit sensor 126.

In this embodiment, the period of time of LOW setting of the charging AC current during double-sided printing on one recording paper P accounts for 50% of the total charge time.

Wear of the photosensitive drum 1 during the LOW setting is less by 30% than that during the regular setting. As a result, the life of the photosensitive drum 1 is extended by 15% in total at double-sided printing on one recording paper P.

When using an image forming apparatus equipped with such a life detection means for estimating the useful life of the photosensitive drum 1 as shown in, for example, Japanese Patent Application Laid-open No. 10-039691, the wear coefficient corresponding to wear of the photosensitive drum 1 per use-time during the LOW setting may be set at 0.7, considering the above 30% improvement in life, in comparison with 1.0 that is the wear coefficient for regular setting (unless LOW setting).

Emodiment 2

Now a second embodiment of the present invention is described below. In the above first embodiment for double-sided printing, what will be printed after a first side of a sheet has been printed is the other side of the same sheet. In other words, when double-sided printing is conducted sheet by sheet, the charging AC high-voltage Vcac is lowered while the period of time the sheet is printed one-sided, turned over and re-fed, and wear of the photosensitive drum 1 can be reduced. The second embodiment will describe to wear of the photosensitive drum 1 can be reduced that can be used one-sided printing with regular printing operation unless double-sided printing on recording paper P.

Figure 9:
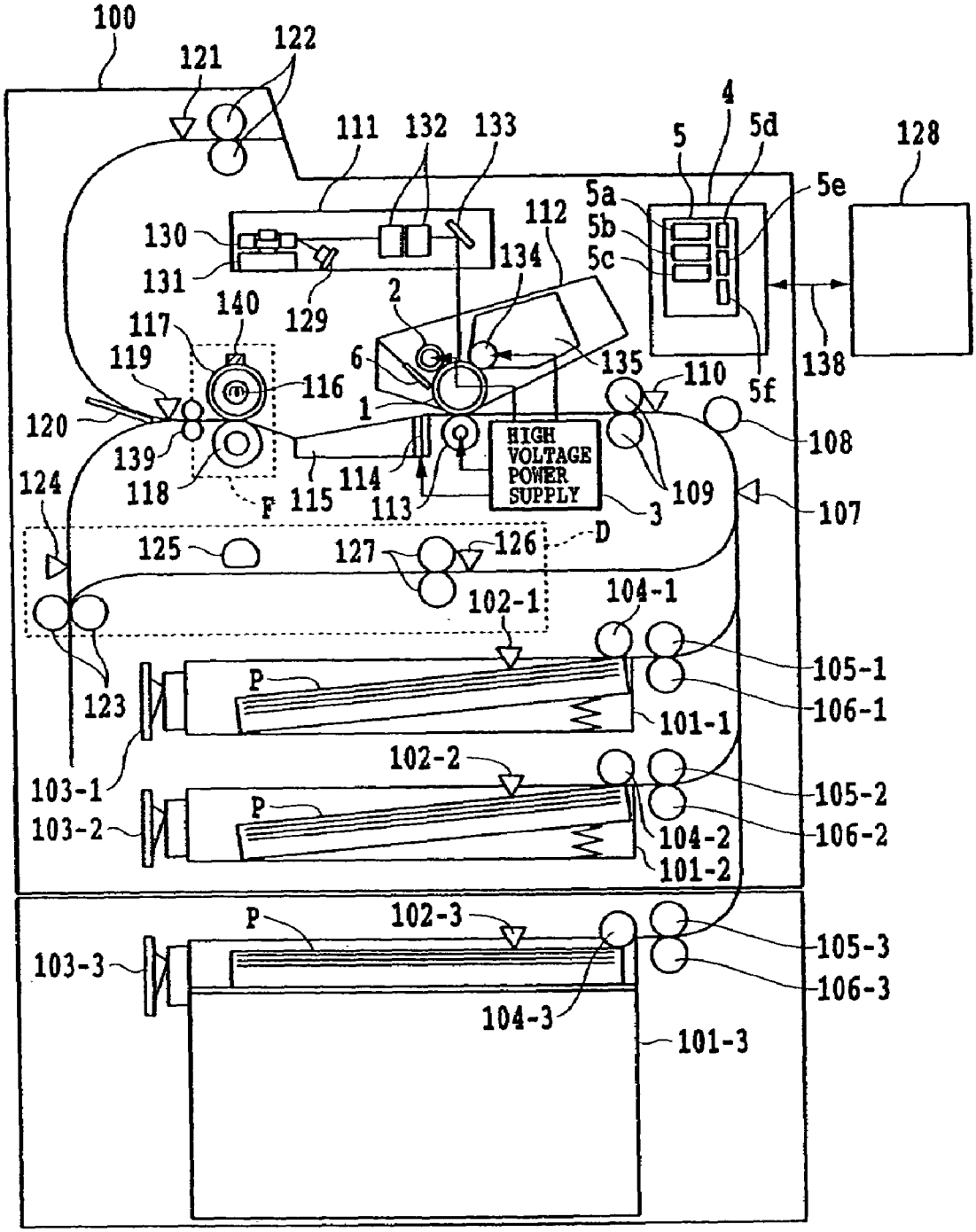
FIG. 9 is a schematic structure of the image forming apparatus of a second embodiment of the invention.

FIG. 9 is a schematic sectional view of the laser beam printer of the second embodiment of the invention. Its structure is very similar to that of the laser beam printer of the first embodiment shown in FIG. 4. It has three paper feeder cassettes 101-1, 101-2 and 101-3 for paper feeding. Corresponding to each of the paper feeder cassettes 101-1, 101-2, and 101-3 are paper cassette detection sensors 102-1, 102-2, 102-3, respectively, paper size sensors 103-1, 103-2, and 103-3, respectively, pick-up rollers, 104-1, 104-2, and 104-3, respectively, transport rollers 105-1, 105-2, and 105-3, respectively, and retard rollers 106-1, 106-2, and 106-3, respectively. The components of the same structures and functions of the laser beam printer of the second embodiment have the same reference numbers throughout the figures, and their descriptions are not repeated.

In the second embodiment, the paper feeder cassettes 101-1 and 101-2 have the same specifications, while the cassette 101-3 is a deck type cassette of a larger capacity.

Figure 10:
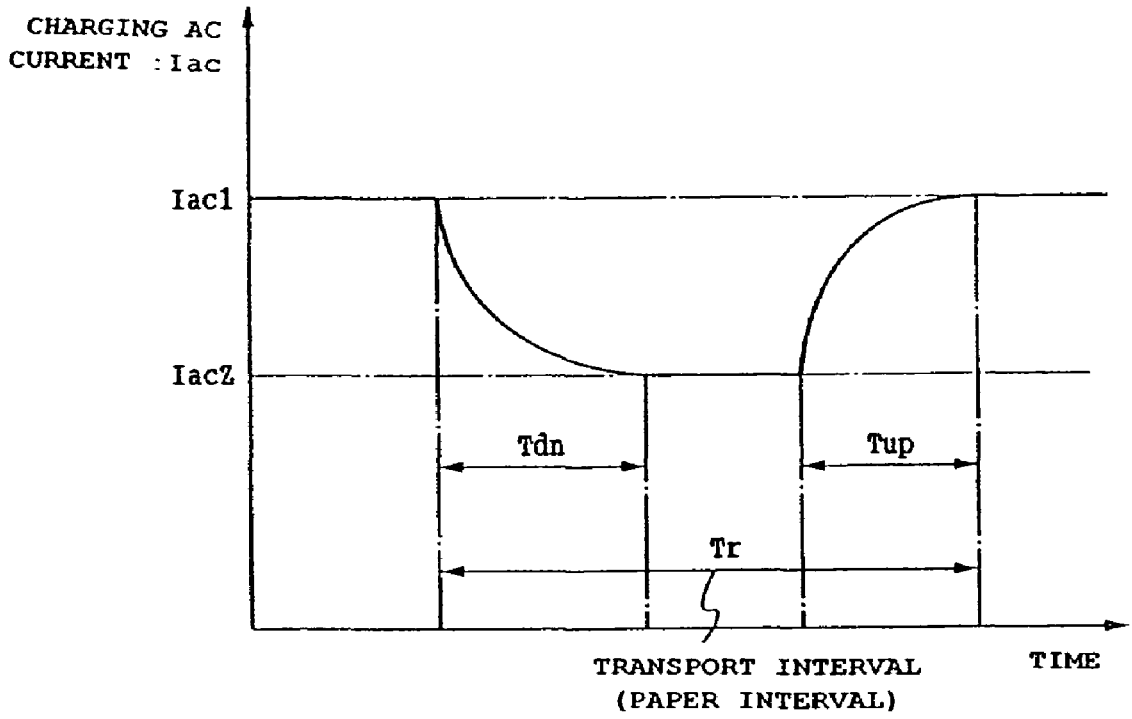
FIG. 10 is a characteristic diagram illustrating the step-down and step-up of charge current.

FIG. 10 shows the characteristics of the step-down and step-up of an AC charge current observed when an AC high voltage for charging Vcac is switched. When the CPU 5 switches the AC charge current Iac1 for printing to IacZ for the LOW setting for the transport interval (paper interval) between a preceding recording paper P and a subsequent recording paper P by controlling the AC high-voltage for charging Vcac, which is loaded to the charging roller 2, the AC current Iac1 for printing reaches the AC charge current IacZ after step-down time Tdn has passed. Meanwhile, when IacZ for the LOW setting is switched to the AC charge current Iac1 for printing, the AC charge current IacZ reaches the AC charge current Iac1 after the step-up time Tup has passed.

A transport interval Tr represents the time between the moment the back end of the preceding recording paper P passes an image transfer nip where the transfer roller 113 contacts the photosensitive drum 1 and the moment the front edge of the subsequent recording paper P reaches the image transfer nip. This transport interval Tr must be long enough to cover both step-down time and step-up time of the AC charge current Iac to conduct printing on each recording paper P with no problem.

In general, during continuous printing for preceding page data printing and subsequent page data printing, a print reservation (discussed further in connection with the description of fourth embodiment) is made and paper feeding is completed earlier for higher throughput (output sheet number of recording paper P per use-time) when the next sheet to be printed is decided. The paper feeding operation of the subsequent recording paper P is completed before the preceding recording paper P is ejected out of printer. The recording papers P are held by the resist rollers 109, and the paper is re-fed with a predetermined timing to secure transport interval Ts for continuous printing.

A transport interval Tt for feeding paper is the time between which a tip of a recording paper P is picked up from the paper feeder cassette 101 by the pick-up roller 104 and the time at which it reaches the resist rollers 109. A waiting time Tw is the time the recording paper P waits in the resist rollers 109. These intervals are decided by the specifications of the employed image forming apparatus. The transport interval of the feeder paper becomes longer depending on the distance from the outlet of each of the paper cassettes 101-1, 101-2 and 101-3 to the resist rollers 109, where Ttl is a transport time of feeder paper from the outlet of the paper cassette 101-1 to the resist rollers 109, and Tt2 and Tt3 are times of transport for feeder paper from each outlet of the paper cassettes 101-2, 101-3, respectively, to the resist rollers 109.

Under such conditions, if a paper sheet comes from a different paper cassette 101 during continuous printing, namely if a paper sheet comes from a different cassette outlet, for example, if a paper sheet comes from the cassette 101-3 instead of the cassette 101-1, the transport interval Tt of feeder paper becomes longer by (Tt3−Tt1). Then the CPU controls such that the charging AC current Iac is altered as explained above during the transport time of feeder paper when Ts+(Tt3−Tt1)>(Tup+Tdn).

Figure 11:
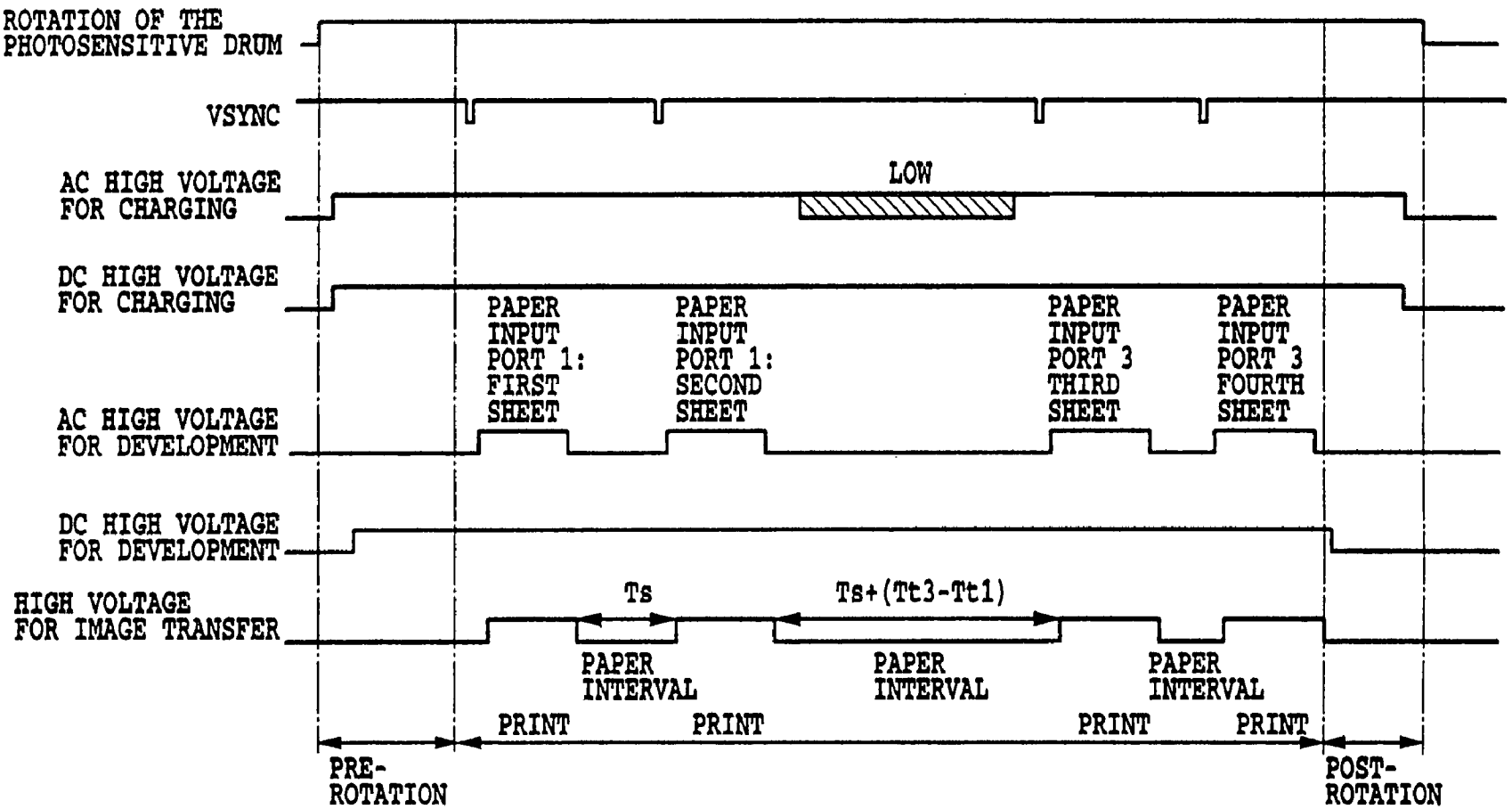
FIG. 11 is a timing chart for continuous single-sided printing in the second embodiment of the image forming apparatus equipped with a plurality of paper feeder ports.

FIG. 11 is a timing chart for single-sided continuous printing in the image forming apparatus of the second embodiment having more than one cassette outlet. This is a timing chart for an operation in which first and second sheets are fed from the cassette 101-1 and then third and fourth sheets are fed from the cassette 101-3.

In this case, the CPU 5 controls such that the charging AC current Iac is set to the LOW value during the paper interval between the second sheet of recording paper P and the third sheet of recording paper P when the cassette outlets have been switched. As a result, the life of the photosensitive drum 1 is prolonged by 30% by virtue of the LOW setting like the first embodiment. This effect of prolonging the useful life of the photosensitive drum 1 is enhanced when the print system switches the cassette outlets frequently.

Figure 12:
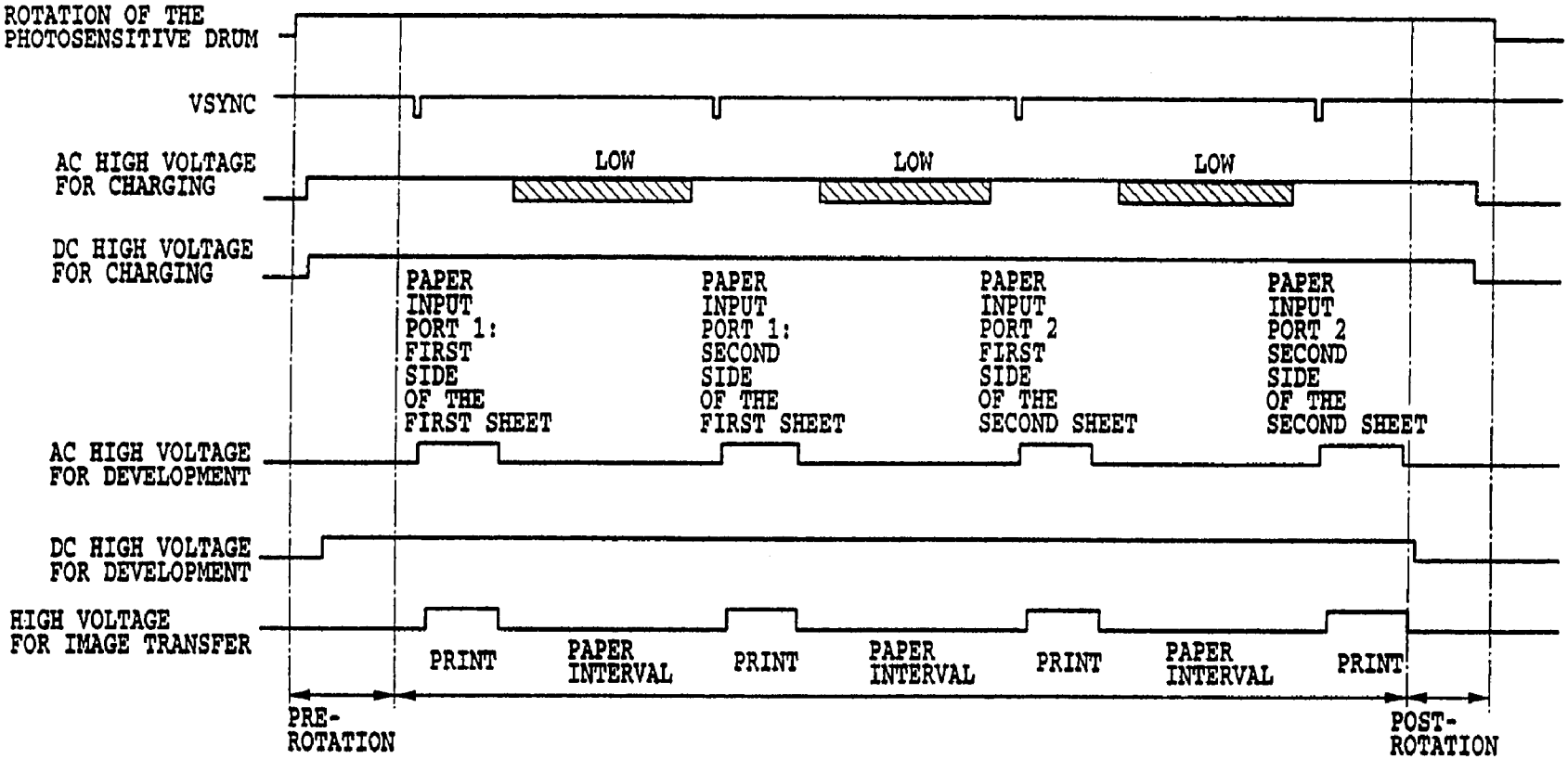
FIG. 12 is a timing chart for continuous double-sided printing in the second embodiment of the image forming apparatus equipped with a plurality of paper feeder ports.

FIG. 12 is a timing chart for double-sided continuous printing in the image forming apparatus having more than one cassette outlet of the second embodiment.

When the paper feeder cassettes 101 or cassette outlets are switched during double-sided printing, namely, when the first sheet is sent from the paper cassette 101-1 for double-sided printing and subsequently the second sheet is sent from the paper cassette 101-2 for double-sided printing, the ratio of time of LOW setting in transport time of feeder paper increases and thereby the effect of prolonging the life of the photosensitive drum 1 is improved.

Emodiment 3

Now a third embodiment of the present invention is described below. Occasionally, paper sheets of having rough surfaces (rough paper) are used in image forming apparatuses. Since it's the rough surface makes it harder for heat to move from the fixer roller 117, its fixing performance (degree of fixing toner on the recording paper) is inferior to that of paper having smooth surface. Thus, throughput (output number of recording paper P per use-time) is lowered to improve fixing performance when rough paper is printed. In general, the temperature of the surface of the pressure roller 118 can be raised by lowing throughput by 30–50%. More heat then moves to the rough paper, and fixing performance is thereby improved.

When such a special setting (hereinafter, referred to as the special sequence) is adopted in fixer F in this way, if the recording material transport interval is extended by changing the transport interval between the preceding recording paper P and the subsequent recording paper P, the time for applying the AC charge voltage Vcac to the photosensitive drum 1 during the formation of an image (printing) on a recording paper sheet P becomes long. The longer the time of loading the AC charge voltage Vcac, the more the life of the photosensitive drum 1 is affected. In the third embodiment, the method of preventing negative impact on the useful life of the photosensitive drum 1 is explained for the case where the transport interval between paper sheets P becomes long because of such a special sequence.

When continuous printing is done by such a special sequence, it is known in advance that the paper transport interval between sheets P will be long. When the image forming apparatus or the host computer has adopted a special sequence, the AC charge current Iac is set at the LOW value during the transport interval of recording paper P even in single-sided continuous printing. Namely, the CPU 5 applies the LOW setting to the AC charge current Iac during the transport interval of recording paper sheets P.

Figure 13:
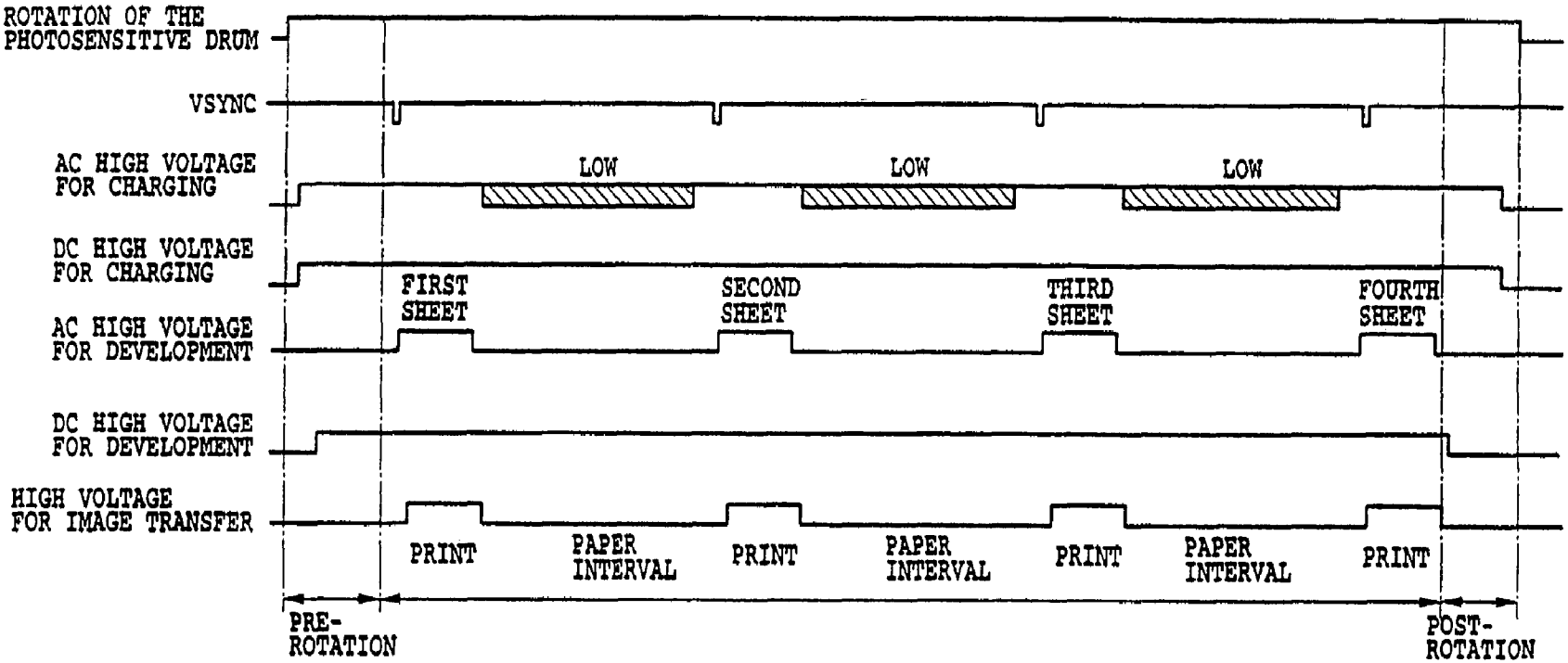
FIG. 13 is a timing chart for the image forming apparatus of a third embodiment.

FIG. 13 is a timing chart of a special sequence for single-sided three-page continuous printing according to the third embodiment of the invention. The transport interval of a preceding recording paper P and a subsequent recording paper P is spread. By lowering throughput by 40%, the transport interval per sheet increases about 400%. If the charging AC current Iac becomes the LOW setting that is adopted during those intervals, the useful time of the photosensitive drum 1 is significantly prolonged in comparison with the situation in which the LOW setting is not used.

As indicated by the above embodiments:

(1) When the paper interval becomes rather long, the AC voltage (current) applied to the charging unit is set at a value lower than that applied during printing (during image to reduce the wear of the photosensitive drum and extend its useful life.

(2) When it is known in advance that the paper interval becomes longer than a prescribed time during continuous printing of plural pages, the AC voltage (current) applied to the charging unit during paper intervals is lowered to the level that impairs image quality if adopted in regular printing.

(3) Unnecessary pick-up of toner can be avoided by setting the photosensitive drum potential during paper intervals, which results from the AC voltage (current) applied to the charging unit, at a value higher than the DC voltage for development.

(4) When the AC voltage (current) is applied to meet the above requirements in such an image forming apparatus that can set plural AC voltage (current) values meeting the above requirements for paper intervals considering fluctuations in conductivity in the charging unit, one value of the AC voltage (current), regardless of the number of those variable settings, is adopted for simplicity.

(5) When it is known that the rotation time of the photosensitive drum during each paper interval becomes longer than the sum of the step-up time and step-down time of the AC voltage (current) applied to the charging unit, the AC voltage (current) applied to the charging unit is lowered during paper intervals.

(6) When double-sided printing is conducted on one sheet at a time during double-sided printing, or it is known that a first side is printed and then the other side is printed per sheet, the charge voltage (current) is lowered during paper turn-over for double-sided printing.

(7) When a continuous printing is conducted using two or more paper cassettes, the charge voltage (current) is lowered during paper intervals if the paper intervals become longer than usual.

(8) When throughput is lower than regular continuous printing, the charge voltage (current) is lowered during paper intervals.

Now fourth and fifth embodiments of the invention will be described below with reference to the accompanying drawings.

Emodiment 4

Figure 14:
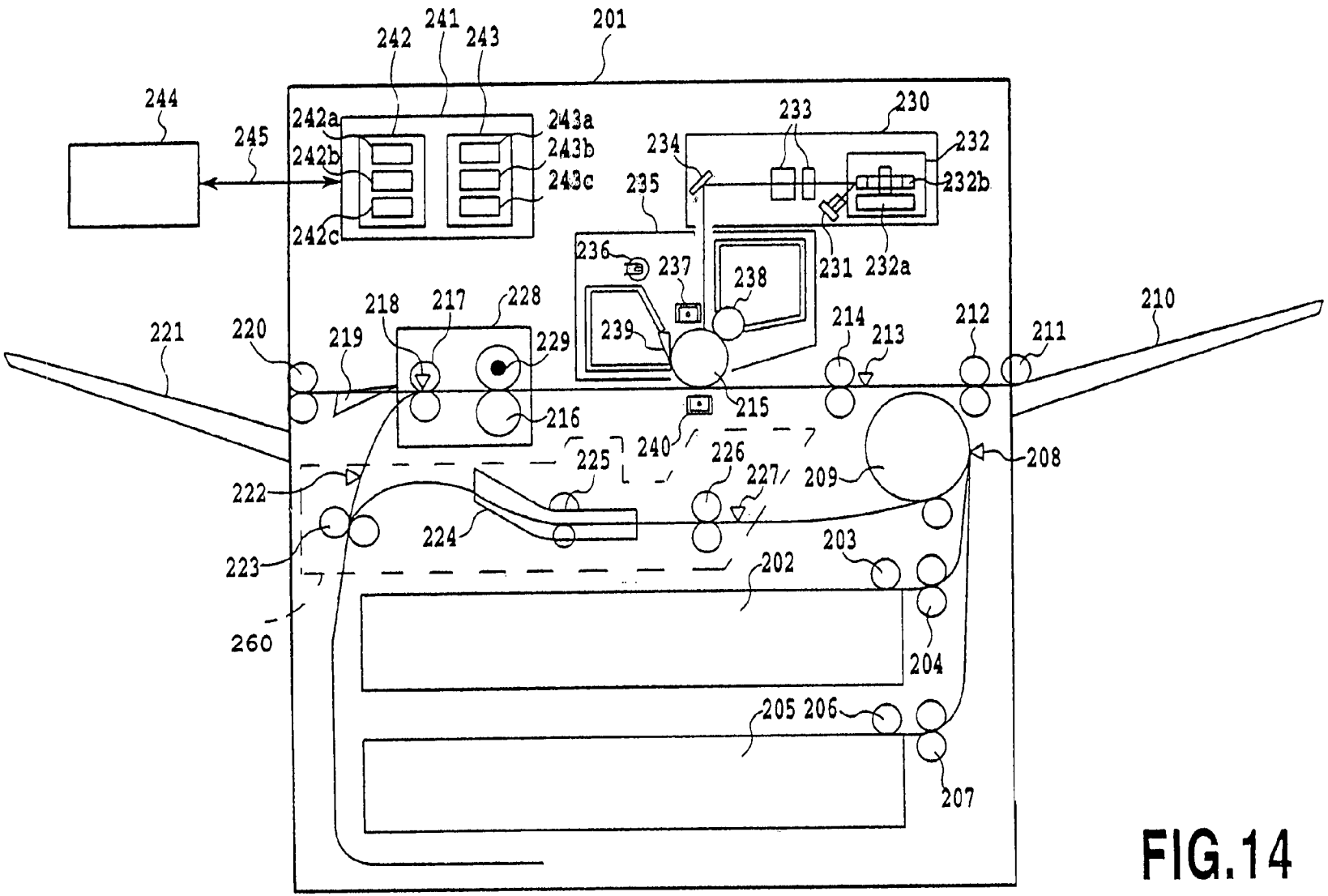
FIG. 14 is a schematic structure of the image forming apparatus of a fourth embodiment and a fifth embodiment of the invention.

FIG. 14 is a schematic diagram illustrating the structure of the image forming apparatus of a fourth embodiment, exemplifying a laser printer. The printer 201 has a top cassette 202 and a bottom cassette 205 that hold recording paper P. The top pickup roller 203 for the top cassette 202 picks up recording paper and the top transport roller 204 transports the recording paper P. The bottom pickup roller 206 for the bottom cassette 205 picks up recording paper P and the bottom transport roller 207 transports the recording paper P. The recording paper P transported from the top cassette 202 or the bottom cassette 205 is detected by a feeder sensor 208 in the downstream, and further transported by the re-feeder roller 209.

Also, from a multi-tray 210 holding recording paper P, a multi-pickup roller 211 picks up recording paper P and multi-transport rollers 212 transport the recording paper P. The recording paper P transported from the top cassette 202, bottom cassette 205 and multi-tray 210 is detected by a resist sensor 213 in the downstream. Paper transport is suspended when a predetermined loop is made for a resist roller pair 214. In synchronization with the image formation timing (VSYNC signal), the resist roller pair 214 resumes transport of the recording paper P.

In the downstream at transport direction of the resist roller pair 214, a process cartridge 235 is installed detachably so as to form toner images on a photosensitive drum (image carrier) 215 by the use of laser light arriving from a laser scanner 230. The toner image on the photosensitive drum 215 is printed onto the recording paper P by a transfer unit 240. Further downstream a fixer unit 228 fixes the toner image formed on the recording paper P by pressure and heat. Downstream in the fixer unit 228, disposed are a fixer exit sensor 218 that monitors the state of transported paper and output rollers 217 that transport the recording paper P to an output tray 221. The recording paper P is ejected to the paper output tray 221 by paper output rollers 220.

For double-sided printing, a flapper 219 guides the recording paper P to a turn-over unit 260. The recording paper P sent to the turn-over unit 260 is detected by a reverse sensor 222 and pulled in the turn-over unit 260 by reverse rollers 223. When pulled in, the recording paper P is turned over by the reverse rotation of the reverse rollers 223 and sent to the transport unit for double-sided printing. The recording paper P sent to the transport unit in the turn-over unit 260 is further transported by a notch roller 225, and stops in the position where the notch of the notch roller 225 touches the recording paper P. When the recording paper P is released, a transverse resist adjustor plate 224 corrects its slanting. After that, the notch roller 225 resumes paper transport and the paper is further transported by the rollers 226 in the transport direction. A sensor 227 confirms the position of the transported paper. The recording paper P is then transported by the re-feeder roller 209 for image formation on the other side.

The laser scanner 230 consists of a laser unit 231 that emits laser light modulated by image signals sent from an external device 244, a scanner motor unit 232 that scans the laser light provided by the laser unit 231 on the photosensitive drum 215, an image formation lens assembly 233, and a return mirror 234. The scanner motor unit 232 consists of a scanner motor 232*a* and a polygon mirror 232*b*. The process cartridge 235 consists of the photosensitive drum 215 needed for electro-photography, a pre-exposure lamp 236, a charger 237, a developer 238, the transfer unit 240 and a cleaner 239.

A printer controller 241 is a device that controls the printer 201, and is comprised of a video controller 242 and an engine controller 243. The video controller 242 mostly consists of a micro computer 242*a*, a timer 242*b* and a memory 242*c*. The engine controller 243 is composed of a micro computer 243*a*, a timer 243*b* and a memory 243*c*.

The printer controller 241 communicates with an external device 244 (for example, a host PC) via an interface 245. Although not shown here, the printer 201 has a control panel 250 (shown in FIG. 15) which shows useful information to the user or the user makes settings with. The fixer unit 228 is a thermal-roller type fixer unit consisting of a heat-pressure roller 216 composed of a thermal roller and a pressure roller and a heater 229 that is a halogen heater installed in the thermal roller. A temperature sensor is attached to the surface of the thermal roller to turn the heater on and off based on the detected temperature and to keep the roller surface temperature constant.

Figure 15:
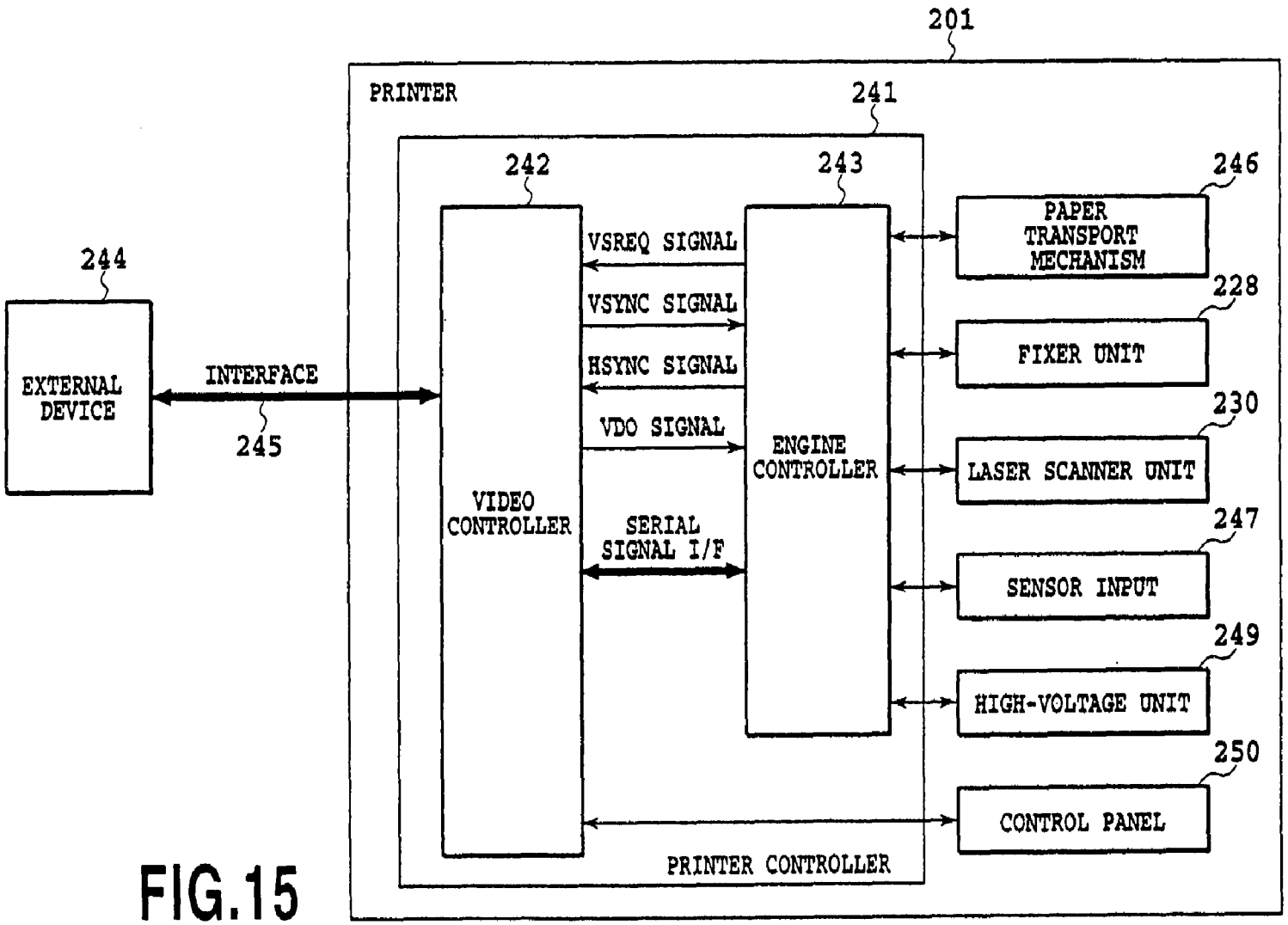
FIG. 15 is a block diagram (No. 1) illustrating the functions of the fourth and fifth embodiments.
Figure 16:
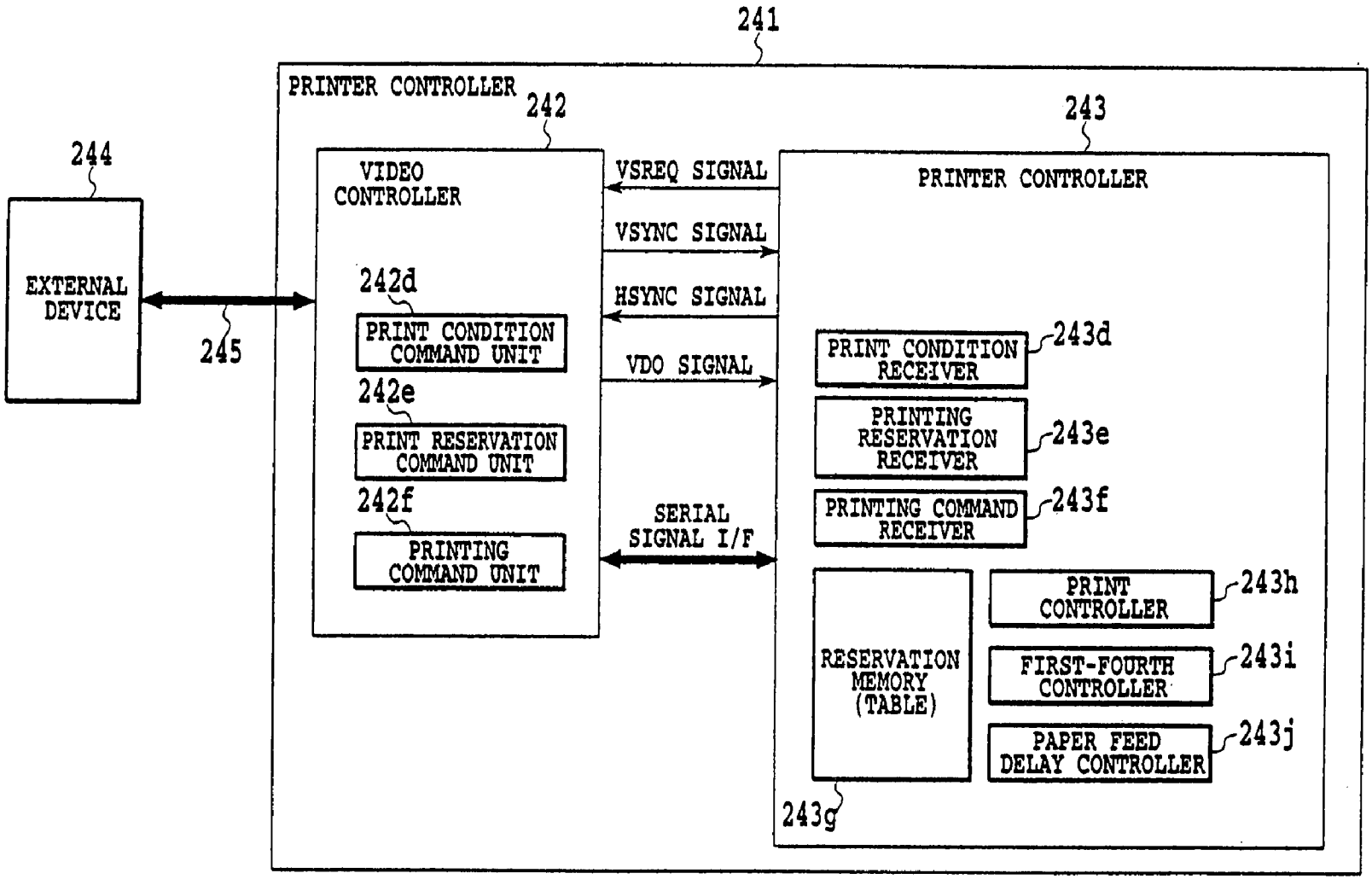
FIG. 16 is a block diagram (No. 2) illustrating the functions of the fourth and fifth embodiments.

FIGS. 15 and 16 are function diagrams of the fourth embodiment. The printer 201 has the printer controller 241 that is composed of the video controller 242 and the engine controller 243. The video controller 242 translates image data, which is sent from the external device 244 like a host computer via the interface 245, into bit data needed for printing.

The video controller 242 assigns an ID to each image in the engine controller 243 via a serial interface (I/F), and lets a print condition command unit 242*d* specify print conditions (feeder port for feeding paper P, output port for transport paper P, etc.), while a print reservation command unit 242*e* makes reservations for printing according to each ID. When the bit data has been translated, the video controller 242 sends a command of printing from a printing command unit 242*f* to the engine controller 243 to perform printing.

The engine controller 243 stores the print conditions and print reservation data in a reservation memory table 243*g* according to the print condition sent from the video controller 242 to a print condition receiver 243*d* and print reservation data received in a print reservation receiver 243*e*, and the print controller 243*h* controls printing. The engine controller 243 rotates the photosensitive drum 215 and feeds paper specified in the print conditions, controlling a paper transport mechanism 246 including the feeder roller, transport roller and lifter. In the high-voltage unit 249 controlled by the engine controller 243, the charger 237 applies charging high-voltage V (additional voltage of the charging AC high-voltage Vcac and charging DC high-voltage Vcdc) to uniformly charge (charging voltage Vd) the surface of the photosensitive drum 215, while the developer 238 applies DC high-voltage Vdc for development.

Based on the printing commands sent from the video controller 242, a printing command receiver 243*f* provides vertical synchronization request signals (VSREQ signal) and waits for vertical synchronization signals (VSYNC signals) sent from the video controller 242. Receiving the VSYNC signal, the engine controller 243 forms images, controlling the laser scanner 230 based on the video signals (VDO signals) sent from the video controller 242, while providing horizontal synchronization signals (HSYNC signals) for each line of video signal.

The formed image is developed by the high-voltage unit 249 in the developer 238 with an AC high-voltage Vac being additionally applied for development, the latent image is formed on the uniformly charged photosensitive drum 215, and then a visible image or toner image is produced by developing this latent image. The engine controller 243 controls such that transfer unit 240 transfers the image onto paper under a high-voltage for image transfer. The toner image is fixed by the fixer unit 228, while the paper transport mechanism 246 sends paper having a fixed toner image to the output port specified in the print condition. The video controller 242 has functions including displaying the printer 201 status on the control panel 250 and recognizing commands provided by the user. The engine controller 243 reads various sensor signals via the sensor input 247 and detects the presence/absence of paper on the transport paths.

In the fourth embodiment, the engine controller 243 controls to operate selectively a first-fourth controller 243*i* and a paper-feed-delay controller 243*j*, based on conditions stored in the reservation memory table 243*g*. In the paper transport mechanism 246, a motor rotates the photosensitive drum 215. The motor is shared with the paper feeder rollers 203, 204, 206, 207, 209, 211, 212 and 214, with the photosensitive drum 215 directly connected to the motor, while the paper feeder rollers are connected with the motor as a state of transmission via a clutch.

Figure 18:
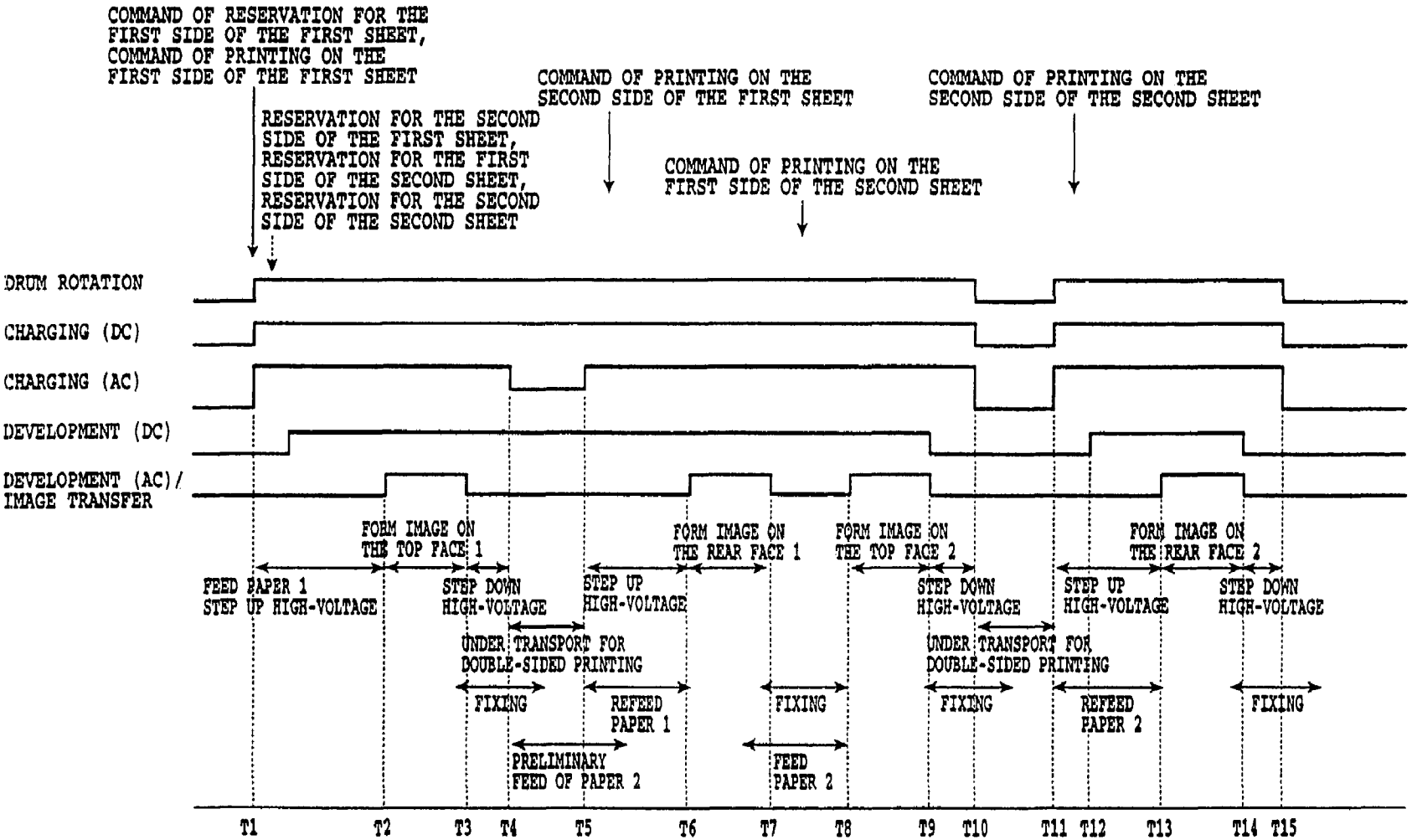
FIG. 18 is a timing chart for printing in the image forming apparatus of the fourth embodiment.

FIGS. 17A–17K are data of print reservation tables for the image forming apparatus of the fourth embodiment, and FIG. 18 is a time chart for printing in the image forming apparatus of the fourth embodiment. Now the sequence of print reservation and printing operation is explained with reference to these figures.

It is assumed in FIGS. 17A–17K and 18 that two sheets of paper in the top cassette 202 in FIG. 14 are double-sided printed and dropped to the output tray 221. Double-sided printing is conducted on one sheet at a time by turning over the sheet, in the order of a first side of the first sheet, the other side of the first sheet, a first side of the second sheet and the other side of the second sheet. The top cassette has at least two A4 size sheets of paper. When the video controller 242 has translated image data into bit data for a first side of the first sheet of recording paper P, it provides to the engine controller 243 an ID for the first side of the first sheet and provides commands for print reservation and printing meeting the print condition (ID=4, feeder port=top, output port=turn-over unit) via a serial interface (I/F) as shown FIG. 17A.

The engine controller 243 receives the print reservation and print signal from the video controller 242 and saves the print conditions (ID, feeder port and output port) and the reserved paper size in the print reservation table 243*g* following the reservation sequence, based on the print reservation. The top cassette 202 automatically detects the paper size as the A4 size and registers it as the regular A4 size. As a state of operation, because no paper has been fed yet, a paper-feed standby state is registered, while no error is registered. As a result, as shown in FIG. 17A, the print reservation information for the first side of the first sheet of recording paper P is registered in the print reservation table.

The video controller 242 provides print reservation commands corresponding to the print conditions for the second side of the first sheet (ID=4, feeder port=turn-over unit, output port=output tray), for the first side of the second sheet (ID=7, feeder port=top cassette, output port=turn-over unit) and for the second side of the second sheet (ID=7, feeder port=turn-over unit, output port=output tray). The engine controller 243 receives the print reservation signal from the video controller 242 and registers a paper-feed standby state with no error because no paper feeding is initiated (as shown FIG. 17B). Now the engine controller 243 starts printing operation on the sheet of ID=4 (first sheet).

First, the engine controller 243 controls such that: the scanner motor 232*a* is activated to start the scanner; the polygon mirror 232*b* is activated to constantly rotate; the photosensitive drum 215 is activated under high-voltage (DC high-voltage Vdc is provided for development after the charging DC high-voltage Vcdc and the charging AC high-voltage Vcac have been applied); and paper feeding is initiated for the paper of ID=4 of the first print condition. Then as shown in FIG. 17B, the status of the first side of the first sheet of ID=4 is changed during paper feeding.

Now that the engine controller 243 has fed paper, after the tip of the recording paper P is transported to resist roller 214 and the video controller 242 has issued a command of printing, image formation is initiated under exchange of vertical synchronization signals (VSREQ signal and VSYNC signal). Specifically, the exposure unit conducts exposure; the developer activated by the DC voltage develops the image; and the transfer unit 240 activated by the high-voltage conducts toner image on the photosensitive drum 215 to the recording paper P. Then as shown in FIG. 17C, the status of ID=4 for the first side of the first sheet is updated to "under printing".

When the engine controller 243 has completed image formation for the first side of the first sheet, the photosensitive drum 215 is kept rotating but the output of the charging AC high-voltage Vcac is lowered. The toner image is fixed, and the paper sheet is turned over and sent to the double-sided printing unit to wait for re-feeding. During this process, the feeder rollers 203, 204 are coupled with the motor by the clutch to conduct preliminary feeding of the recording paper P of ID=7 (first side of the second sheet). Namely, the paper is transported from the top cassette 202 to the upstream of the feeder sensor 208 not to be nipped by the re-feeder rollers 209 for standby. As shown in FIG. 17D, the status of ID=4 for the first side of the first sheet is changed to "under transport for double-sided printing" and the status of ID=7 for the first side of the second sheet is changed to "under feeding".

When the first side of the first sheet has reached the position for re-feeding, the engine controller 243 restores the charging AC high-voltage Vcdc output for charging and re-feeds the paper for printing on the second side of the first sheet. During this process, the video controller 242 translates the image bit data for the second side of the first sheet and then gives to the engine controller 243 a command of printing on the second side of the first sheet. As shown in FIG. 17E, the status of ID=4 for the second side of the first sheet is changed to "under feeding", while the status of the first sheet is changed to "second side under processing" because the printing on the second side is underway as shown in FIG. 17E.

Now that the engine controller 243 has completed paper re-feeding and the video controller 242 has issued a command of printing, image formation is initiated under exchange of vertical synchronization signals (VSREQ signal and VSYNC signal). At the same time, as shown in FIG. 17F, the status of ID=4 for the second side of the first sheet is updated to "under printing".

The engine controller 243 resumes the feeding of the second sheet for printing on its first side, and the image formation on the second side of the first sheet is completed and the toner is fixed. The engine controller 243 controls that the video controller 242 issues a command of printing on the first side of the second sheet, and the image formation on the first side of the second sheet is initiated. As shown in FIG. 17G, when the first sheet is sent out, the status of ID=4 for the first and second sides of the first sheet is deleted, while the status of the first side of the second sheet related to printer 201 is updated to "under printing".

When the image formation on the first side of the second sheet is completed, the engine controller 243 steps down the high-voltage (steps down the DC high-voltage Vdc for development and the high-voltage for image transfer, and then terminates both the charging DC high-voltage Vcdc and the charging AC high-voltage Vcac), and stops the rotation of the photosensitive drum 215. In this example, because there is no subsequent print reservation after printing on the second side of the second sheet, no preliminary feeding is necessary. Thus there is no need to activate the feeder roller 203, and the photosensitive drum 215 can be deactivated. The toner image is fixed, and the paper sheet is turned over by turn-over unit 260 and sent to the double-sided printing unit 261 for re-feeding. As shown in FIG. 17H, the status of ID=7 for the first side of the second sheet is updated to "under transport for double-sided printing".

When the second sheet has been sent to the position for re-feeding for printing on the second side, the engine controller 243 resumes the rotation of the photosensitive drum 215 and steps up the high-voltage unit 249 (provides the charging DC high-voltage Vcdc and charging AC high-voltage Vcac and then provides the DC high-voltage Vdc for development), and re-feeds the second sheet for printing on its second side. As shown in FIG. 17I, the status of ID=7 for the second side of the second sheet is updated to "under feeding", and the status of the second sheet is changed to "second side under processing" because the printing operation has moved to the second side from the first side of the second sheet.

After the image data is translated to bit data for printing on the second side of the second sheet, the video controller 242 issues to the engine controller 243 a command of printing on the second side of the second sheet. Now that the engine controller 243 has completed paper re-feeding and the video controller 242 has issued a command of printing, image formation is initiated under exchange of vertical synchronization signals (VSREQ signal and VSYNC signal). At the same time, as shown in FIG. 17J, the status of ID=7 for the second side of the second sheet is updated to "under printing".

When image formation is completed, the engine controller 243 steps down the high-voltage unit 249 (steps down the high-voltage Vdc for development and for image transfer, and then terminates both the charging DC high-voltage Vcdc and the charging AC high-voltage Vcac), and suspends the rotation of the photosensitive drum 215. The scanner motor is also deactivated. As shown in FIG. 17K, when the second sheet is sent out from the printer 210 to the output tray 221 after printing on its second side is over, the status of ID=7 for the first and second sides of the second sheet is deleted, and now there is no print reservation.

As indicated in the timing chart for printing shown in FIG. 18, in which that two sheets of paper in the top cassette 202 are double-sided printed and dropped to the output tray 221, at T1 the photosensitive drum 215 begins rotation, the charging AC high-voltage Vcac and the charging DC high-voltage Vcdc are stepped-up by the high-voltage unit 249, and paper feeding is initiated. Then, the DC high-voltage Vcdc for development is stepped up. After paper feeding is completed, an image is formed (T2–T3) on the first side of the first sheet (the AC high-voltage Vac for development and high-voltage for image transfer are provided during image information), the toner image is fixed, and the output of charging AC high-voltage Vcac is lowered (T3–T4), and preliminary feeding is initiated for printing on the first side of the second sheet (T4).

After image fixing on the first side of the first sheet, the paper is turned over and sent to the position for re-feeding. When the first sheet is sent to the position for re-feeding, the AC high-voltage Vcac for the charger is stepped-up (T5–T6) and the first paper is re-fed for printing on its second side. After the step-up of high-voltage Vcac and completion of paper re-feeding, image formation on the second side of the first sheet is initiated (T6). Then the second sheet is fed again (T7–T8) for printing on its first side (T8), while the image formed on the second side of the first sheet is affixed (T7–T8). After the completion of feeding of the second sheet, image formation is started (T8). After an image is formed on the first side of the second sheet and the image is affixed (T9), the high-voltage of high-voltage unit 249 is stepped down (terminates the DC high-voltages Vdc for development and image transfer, and then terminates both the charging AC high-voltage Vcac and the charging DC high-voltage Vcdc) (T9), and the photosensitive drum 215 rotation is suspended (T10).

When the image on the first side of the second sheet is affixed and the second sheet has been sent to the position for re-feeding for printing on its second side (after turned over and sent to the position for re-feeding), the rotation of the photosensitive drum 215 is resumed (T11) and the high-voltages of the high-voltage unit 249 are stepped up (the charging DC high-voltage Vcdc and the charging AC high-voltage Vcac are stepped up and then the DC voltage Vdc for development is stepped up), and the second sheet is re-fed for printing on its second side (T11). After the step-up of the high-voltages of the high-voltage unit 249 and completion of paper re-feeding (T12), an image is formed on the second side of the second sheet. After image formation on the second side of the second sheet (T1–T14), the high-voltages of the high-voltage unit 249 are stepped down (terminate high-voltages for development and image transfer, and terminate both the charging AC high-voltage Vcac and the charging DC high-voltage Vcdc), and the photosensitive drum 215 rotation is stopped (T14–T15). The image is affixed, and the paper is ejected.

As described here, the highest throughput the printer 201 can achieve is attained with no cost-up by the preliminary feeding of the subsequent recording paper (second sheet) while the first sheet P is turned over and transported to the position for double-sided printing during the time between the moment image formation on the first side of the first sheet P is completed and the moment of printing on the second side of the first sheet.

If the rotation of the photosensitive drum 215 is suspended during paper transport in the turn-over unit and the high-voltage unit 249 is deactivated, it is possible to prevent the charging AC high-voltage Vcac from giving negative impact on the useful life of the photosensitive drum 215. In the printer 201 of the fourth embodiment, however, the driving source for the photosensitive drum 215 shares the same motor with that for the feeder roller that conducts preliminary paper feeding during paper transport in the turn-over unit. In this type of printer 201, the feeder roller must be kept activated for preliminary paper feeding during paper transport in the turn-over unit, and thus the photosensitive drum 215 sharing the same driving source with this roller cannot be stopped. Then it becomes possible to reduce wear of the photosensitive drum 215 while conducting preliminary paper feeding, by lowering the output of the charging AC high-voltage Vcac during paper transport in the turn-over unit.

When the output of the charging AC high-voltage Vcac is lowered, if the potential Vd of the photosensitive drum 215 for charging, which is the sum of charging DC high-voltage Vcdc and the lowered charging AC high-voltage Vcac, is set at a value higher than the DC high-voltage Vdc for development (AC high-voltage Vac is absence), unnecessary pick-up of toner is preferably prevented, and stains and waste of toner can be prevented. Because the interval between printing on the second side of the first sheet and that on the first side of the second sheet is a regular transport interval time Tr, the output to the charger is not changed. There is no need to conduct preliminary paper feeding in the interval between printing on the first side and on the second side of the second sheet during the time while the first sheet is turned over and sent to the position for re-feeding, because there is no reservation of subsequent printing.

Then it is possible to further reduce wear of the photosensitive drum by terminating the output of both the charging DC high-voltage Vcdc and the charging AC high-voltage Vcac and by suspending rotation of the photosensitive drum 215 during this period of time. After the image is formed on the second side of the second sheet, there is no subsequent printing. Thus, both the charging AC high-voltage Vcac and the charging DC high-voltage Vcdc are immediately turned off, and the rotation of the photosensitive drum 215 is suspended to reduce wear of the drum. In this embodiment, the timing of restoring the output of which AC voltage for charging has been lowered during paper transport in the turn-over unit is the timing of re-feeding. The photosensitive drum 215 turns once after the high-voltage has been restored, so that the surface of the photosensitive drum 215 is uniformly charged before exposure.

Similarly, the timing of resuming the terminated output of the DC and AC voltages for charging is the timing of re-feeding. The photosensitive drum 215 turns once after the high-voltage has been restored, so that the surface potential Vd of the photosensitive drum 215 is uniformly charged before exposure.

Figures 19, 19A:
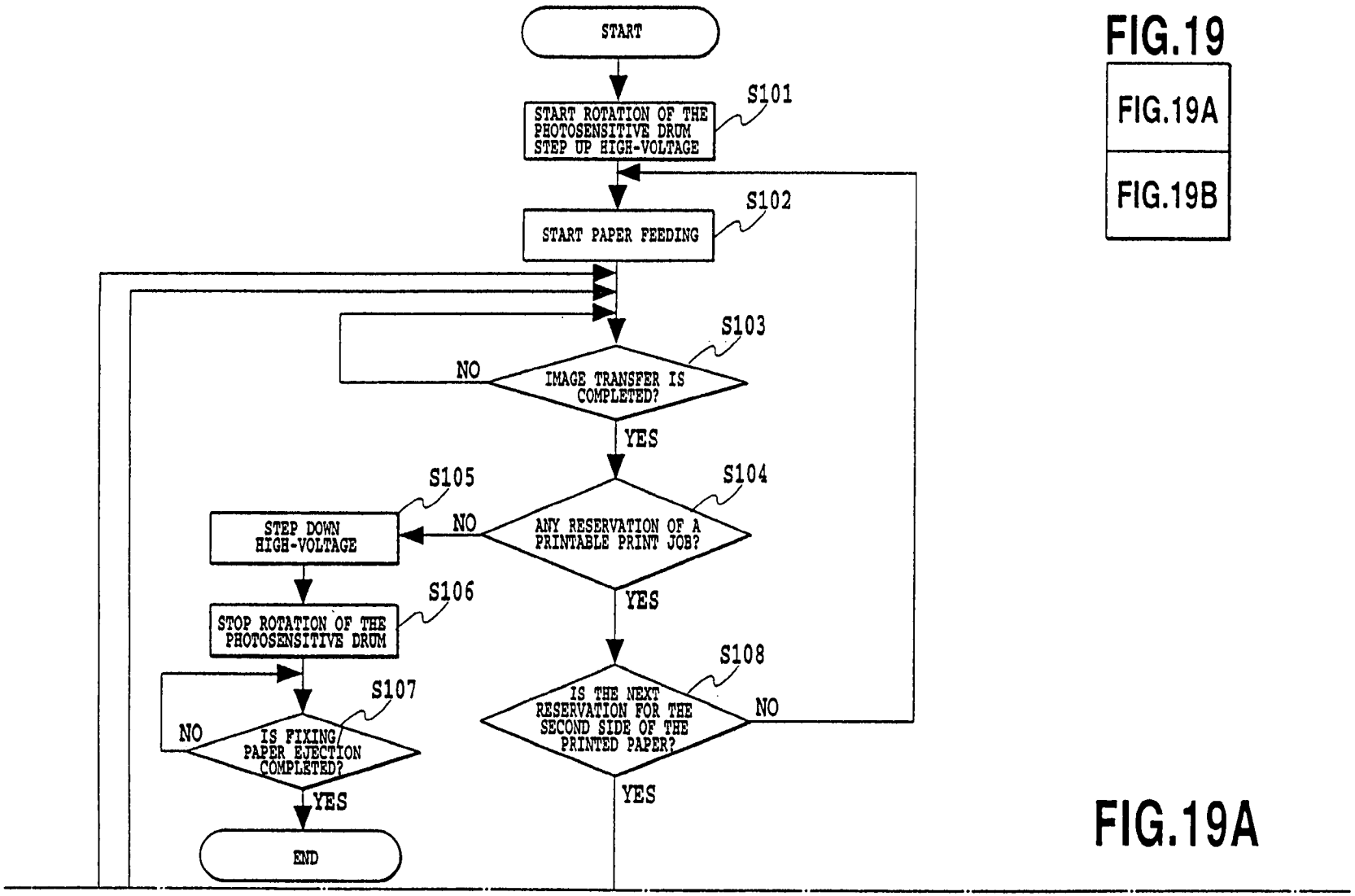
FIG. 19 is a flowchart showing the relationship of FIGS. 19A and 19B.
FIG. 19A is a flowchart (No. 1) illustrating the printing operation of the engine controller of the image forming apparatus of the fourth embodiment.
Figure 19B:
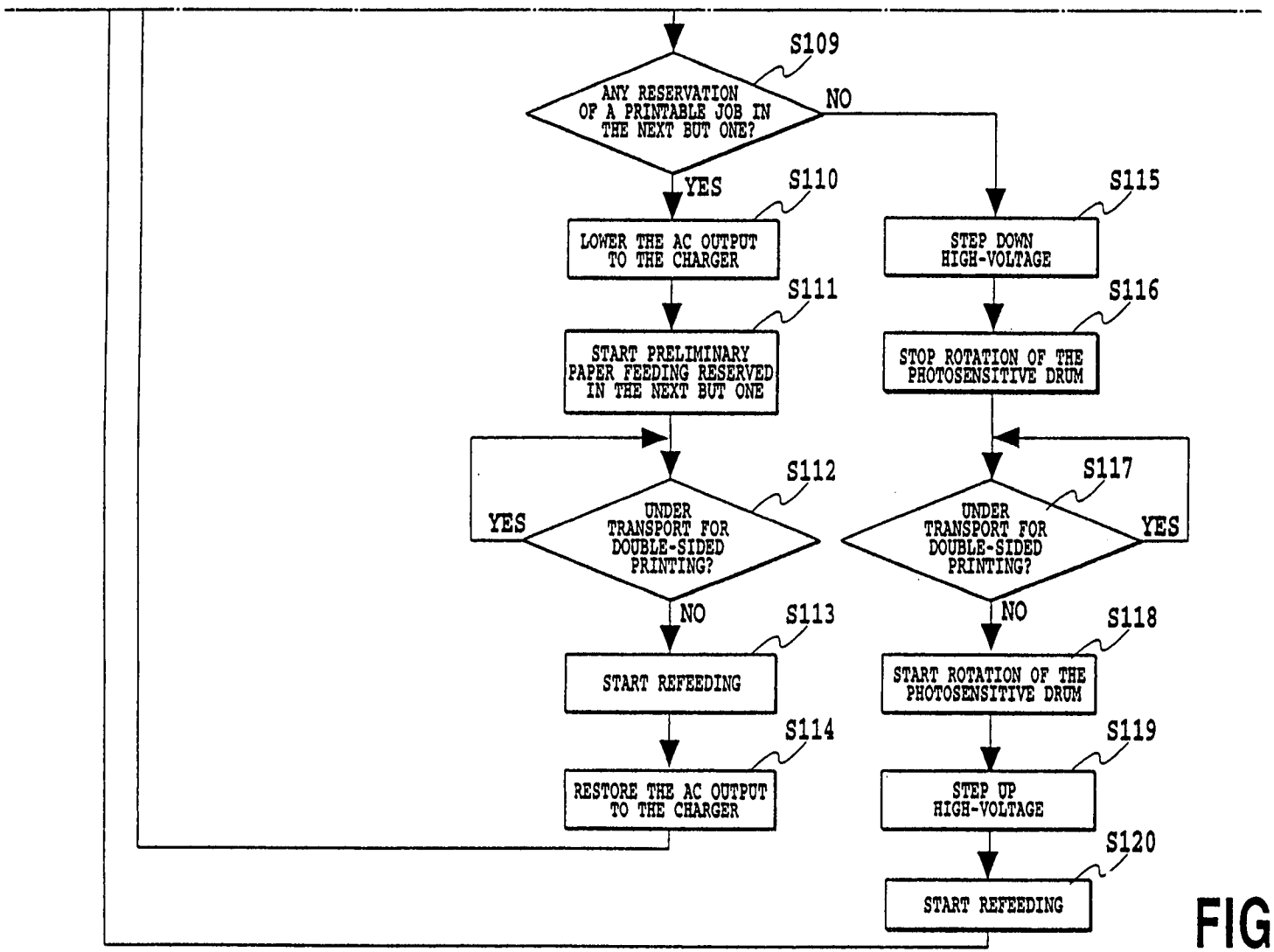
FIG. 19B is a flowchart (No. 2) illustrating the printing operation of the engine controller of the image forming apparatus of the fourth embodiment.

FIGS. 19A and 19B are a flowchart illustrating the steps of a printing operation in the engine controller 243 of the image forming apparatus of the fourth embodiment. This flowchart focuses on the steps of paper feeding and image formation. Printing operation is initiated by the commands of print reservation and printing received from video controller 242 that enable the printing operation.

First, the engine controller 243 controls such that the photosensitive drum 215 and high-voltage unit 249 are activated (both the charging AC high-voltage Vcac and the charging DC high-voltage Vcdc are provided and then the DC high-voltage Vdc for development is provided) (step S101). Paper feeding is started (step S102) and image transfer (image formation) is completed (step S103). During image formation, the AC high-voltage Vac for development and high-voltage for image transfer are provided. After image transfer is over, it is checked whether any printable subsequent print reservation exists or not (step S104). Unless there is any printable print reservation, the high-voltages are stepped down (by terminating the high-voltages for development and for image transfer, and then terminating both the charging AC high-voltage Vcac and the charging DC high-voltage Vcdc) (step S105), and the rotation of the photosensitive drum is ceased (step S106). After image fixing and paper ejection (step S107), the printing operation is over.

If there is any printable print reservation after image transfer, it is checked whether the next reservation is that for printing on the second side of the sheet of which printing has been ended (step S108). If not, the process returns to step S102 to conduct printing for the subsequent reservation. If so, it is checked whether the next printable print reservation exists or not (step S109).

If it exists, the output of AC voltage for charging is lowered (step S110), and the preliminary paper feeding is conducted for printing reserved in the next one (step S111). Then the first sheet is affixed, turned over, and transported to the position for re-feeding (step S112). When such transport is completed, the paper sent to the position for re-feeding is re-fed for printing on the other side (step S113), and the output of the charging AC high-voltage Vcac is restored (step S114). Then an image is formed on the second side, and the process returns to step S103.

On the other hand, if there is no next printable print reservation at step S109, the high-voltages are stepped down (by terminating the output of the high-voltages for development and image transfer) (step S115), and the rotation of the photosensitive drum is ceased (step S116). The image on the first side is fixed, and the paper is turned over and transported to the position for re-feeding (step S117).

When such transport is completed, the rotation of the photosensitive drum 215 is resumed (step S118), the high-voltages are stepped up (by providing both the charging AC high-voltage Vcac and the charging DC high-voltage Vcdc and then providing the DC high-voltage Vdc for development) (step S119), and the paper sent to the position for re-feeding is re-fed for printing on its second side (step S120). Then an image is formed on the second side, and the process returns to step S103.

As explained above, throughput has been maximized with no rise in cost by the preliminary feeding of the second sheet in the print interval between printing on the first side of the first sheet and on the second side of the first sheet, specifically during the period while the first sheet is turned over and sent to the position for re-feeding for printing on the other side. However, the feeder roller must be rotated for the preliminary paper feeding during paper transport in the turn-over unit 260, and it is therefore impossible to deactivate the photosensitive drum 215 that shares the same driving source with the feeder roller. Thus, during this period of time, the output of AC voltage for charging is lowered, so as to reduce wear of the photosensitive drum 215 while conducting preliminary paper feeding. In fact, compared with the time of no decrease in the output of AC voltage for charging during the regular paper interval, the wear of the drum is reduced by 30% when the output of AC voltage for charging is lowered.

Since the interval between printing on the second side of the first sheet and that on the first side of the second sheet is a regular paper interval, the output to the charger is not changed. There is no need to conduct preliminary paper feeding in the interval between printing on the first side and on the second side of the second sheet, because there is no reservation of subsequent printing during the time the first sheet is turned over and sent to the position for re-feeding. Then it is possible to further reduce wear of the photosensitive drum 215 by terminating the output of both the charging DC high-voltage Vcdc and the charging AC high-voltage Vcac, and by suspending the rotation of the photosensitive drum 215 during this period of time.

The photosensitive drum 215 does not wear when it is not rotating or high-voltage is not applied. After image formation on the second side of the second sheet, there is no subsequent print to be done. Thus, both the charging AC high-voltage Vcac and the charging DC high-voltage Vcdc are immediately turned off, and the rotation of the photosensitive drum 215 is terminated to reduce wear of the drum. As a result, it becomes possible to prevent the photosensitive drum 215 from wearing in the optimized manner for double-sided printing, while maintaining throughput at the maximum with no rise in cost.

Moreover, it is more preferable to store data on the degree of photosensitive drum 215 wear and remaining life of the photosensitive drum 215 in non-volatile memory (whether contact type or non-contact type using an antenna) because the photosensitive drum 215 can be used over its full life, which has been prolonged by the invention. Such data is provided, as disclosed in Japanese Patent Application Laid-open No. 10-039691, by considering the rate of wear based on the rotation time of the photosensitive drum 215, the regular time of output of the charging AC high-voltage Vcac and the time of lowered output of the AC voltage.

Emodiment 5

FIG. 14 is a structure of the image forming apparatus of a fifth embodiment of the present invention. FIGS. 15 and 16 are block diagrams illustrating the functions of the image forming apparatus of the fifth embodiment. Because they are the same as those of the fourth embodiment, their explanation is not repeated.

Figure 21:
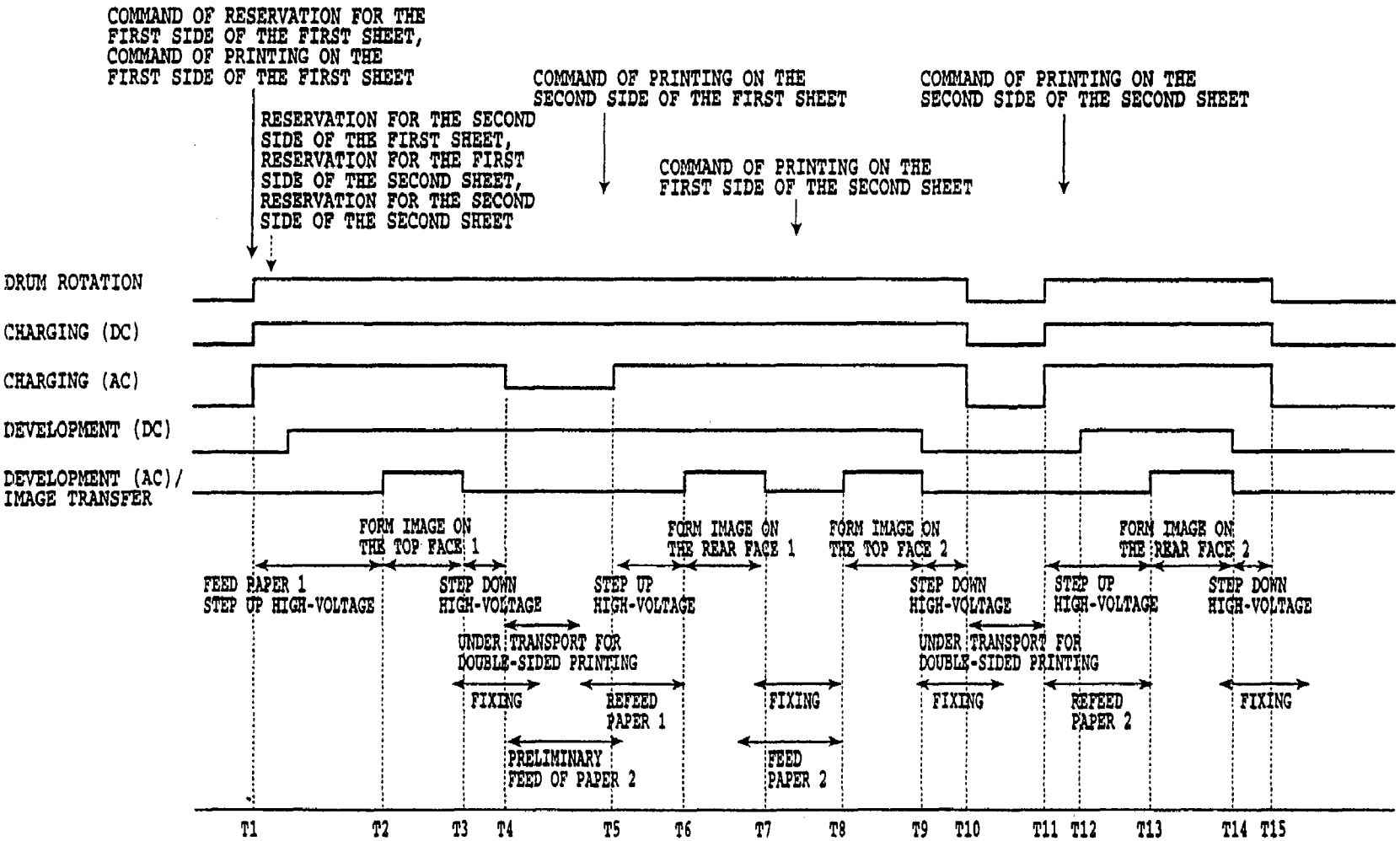
FIG. 21 is a timing chart (double-sided printing on two sheets) in the image forming apparatus of the fifth embodiment.
Figure 23:
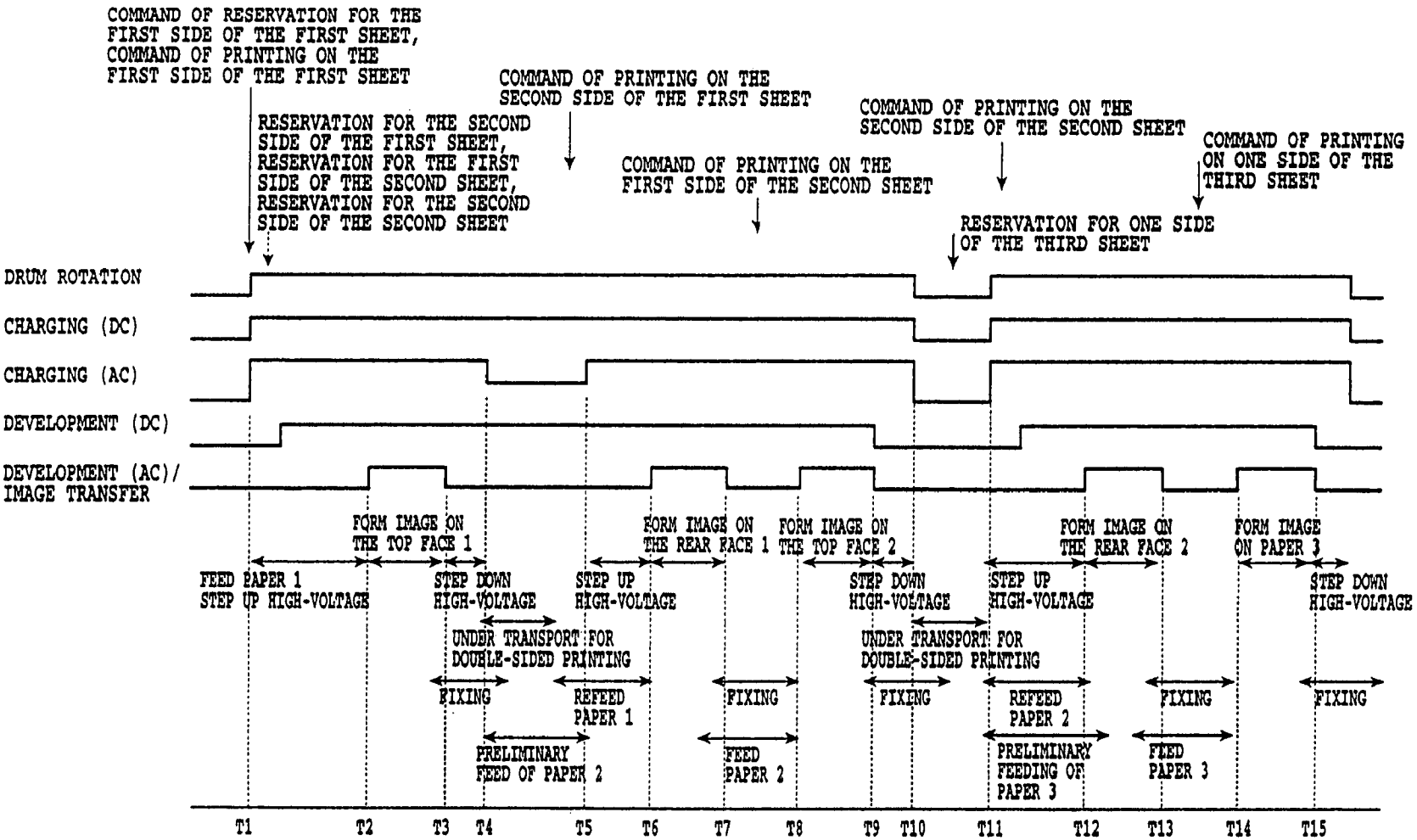
FIG. 23 is a timing chart (double-sided printing on two pages and single-sided printing) in the image forming apparatus of the fifth embodiment.

FIGS. 20A–20K and 22A–22M are print reservation tables for the image forming apparatus of the fifth embodiment. FIGS. 21 and 23 are timing charts for printing in the image forming apparatus of the fifth embodiment. FIGS. 20A–20K correspond to FIG. 21, and FIGS. 22A–22M correspond to FIG. 23. With reference to those figures, the print reservation and the sequence of printing in the invention will be described below.

In FIGS. 20A–20K and FIG. 21, it is assumed that two paper sheets from the top cassette 202 are ejected to the output tray 221 after double-sided printing. Double-sided printing is conducted on each sheet at a time in the order of the first side of the first sheet, second side of the first sheet, first side of the second sheet and second side of the second sheet. The top cassette 202 has at least two A4-size paper sheets. Because FIGS. 17A–17K for the fourth embodiment are very similar to FIGS. 20A–20K, the differences are described here.

In the print reservation tables, the differences lie only between FIG. 17H for the fourth embodiment and FIG. 20H for the fifth embodiment. Because the feeder roller is not operable, preliminary paper feeding is disabled while the high-voltages are stepped down (high-voltages for development and image transfer are terminated and then both the DC and AC voltages for charging are terminated) after image formation on the first side is over, the rotation of the photosensitive drum 215 is stopped and the paper is under transport in the turn-over unit (the paper is turned over and transported to the position for re-feeding). Thus in this embodiment, preliminary paper feeding is prohibited during this period of time and preliminary paper feeding is delayed.

In FIG. 20H, while the second sheet is under transport in the turn-over unit for double-sided printing, an error prohibiting preliminary paper feeding is written in the reservation of the subsequent prints. When the second sheet has been transported to the position of re-feeding, the rotation of the photosensitive drum is resumed, and the second paper is re-fed for printing on the second side, then preliminary feeding is permitted. In FIG. 201, the error prohibiting preliminary feeding of the second sheet is deleted and the status is changed to "under feeding".

In terms of the timing charts for printing, the differences lie only between FIG. 18 for the fourth embodiment and FIG. 21 for the fifth embodiment in the timing of re-feeding of the first sheet for printing on its second side and the timing of stepping up high voltage of restoring the charging AC high-voltage Vcac. In the fifth embodiment, the charging AC high-voltage Vcac is restored after the time (T5) of step-up of charging AC high-voltage Vcac has passed before starting image formation (T6). As a result, compared with FIG. 18 for the fourth embodiment where the charging AC high-voltage Vcac is restored upon re-feeding, the time of low output of the charging AC high-voltage Vcac becomes longer and therefore the wear of the photosensitive drum 215 can be reduced.

In FIGS. 22A–22M and FIG. 23, it is assumed that two paper sheets from the top cassette 202 are ejected to the output tray 221 after double-sided printing and that single-sided printing is conducted on one sheet that is sent from the bottom cassette 205 to the output tray 221 during the transport of the second sheet for printing on its second side (while the rotation of the photosensitive drum 215 is suspended). Double-sided printing is conducted on each sheet at a time in the order of the first side of the first sheet, second side of the first sheet, first side of the second sheet and second side of the second sheet. The top cassette 202 has at least two A4-size paper sheets, and the bottom cassette 205 has at least one A4-size sheet of paper.

Because FIGS. 22A–22H are the same as FIGS. 20A–20H, FIG. 221 and the latter figures are explained here.

Because the feeder roller is not operable, preliminary paper feeding is disabled while the high-voltage is stepped down (high-voltages for development and image transfer are terminated and then both the DC and AC voltages for charging are terminated) after image formation on the first side is over, the rotation of the photosensitive drum 215 is stopped and the paper is under transport in the turn-over unit (the paper is turned over and transported to the position for re-feeding). Thus in this embodiment, preliminary paper feeding is prohibited during this period of time and preliminary paper feeding is delayed.

In FIG. 22H, while the second sheet is under transport in the turn-over unit for double-sided printing, an error prohibiting preliminary paper feeding is written in the reservation of the subsequent prints. It is assumed that the video controller 242 issues a command of print reservation with a print condition for a side of the third sheet (ID–14, feeder port=bottom cassette, output port=output tray). When the engine controller 243 receives the command of print reservation for a side of the third sheet, it enters the condition in the print reservation table 243*g*. However, because the printing process is now in the period of prohibiting preliminary paper feeding when the feeder roller cannot be activated, an error prohibiting preliminary feeding is written in the table to prohibit preliminary paper feeding. As shown in FIG. 221, the printing on one side of the third sheet of ID–14 is listed with the status of "standby for feeding" and "error=prohibiting preliminary paper feeding".

When the transport of the second sheet for double-sided printing is over, the rotation of the photosensitive drum is resumed, and the second paper is re-fed for printing on the second side, then preliminary feeding is enabled and preliminary feeding of the third sheet is initiated. In FIG. 22J, the error prohibiting preliminary feeding for the second sheet and the third sheet is deleted, and the status of the second sheet and that of the third sheet are changed to "under feeding". With respect to the first side of the second sheet, since printing on the second side of the second sheet is already started, the status is changed to "second side under processing".

When the video controller 242 has translated the image data into bit data for printing on the second side of the second sheet, it provides to the engine controller 243 a printing command for the second side of the second sheet. Now that the engine controller 243 has completed paper re-feeding and the video controller 242 has issued a command of printing, image formation is initiated under exchange of vertical synchronization signals (VSREQ signal and VSYNC signal). At the same time, as shown in FIG. 22K, the status of ID–7 for the second side of the second sheet is updated to "under printing".

When the engine controller 243 has completed image formation on the second side of the second sheet, the toner image is fixed and the sheet is ejected. When it receives the printing command for one side of the third sheet, it completes the paper feeding of the third sheet and starts image formation thereon. As shown in FIG. 22L, when the second sheet is ejected, the status information about the first and second sides of the second sheet is all deleted, and the status of the third sheet is changed to "under printing". When image formation on the one side of the third sheet is over, the high-voltages are stepped down (the high-voltages for development and image transfer are terminated and then the charging DC high-voltage Vcdc and the charging AC high-voltage Vcac are terminated), and the rotation of the photosensitive drum 215 is stopped. The scanner motor is also deactivated.

As shown in FIG. 22M, when the third sheet is ejected, the information about ID=14 for one side of the third sheet is deleted and no reservation is left. In the timing charts of printing, the only difference between FIG. 21 and FIG. 23 is that the step for one side of the third sheet is added in FIG. 23. As indicated by an arrow in FIG. 23, printing for one side of the third sheet is reserved by the reservation memory 243*g* under command from the printing command unit 242*f* of the video controller 242 while the photosensitive drum is deactivated during paper transport for double-sided printing (T10–T11). Because the photosensitive drum 215 is deactivated and the feeder roller cannot be rotated (T10–T11), preliminary paper feeding is not started. Instead, preliminary paper feeding is started when the rotation of the photosensitive drum 215 is resumed and the feeder roller becomes operable.

Then a paper jam is avoided by preventing preliminary paper feeding while the feeder roller is deactivated. As soon as the feeder roller becomes operable, preliminary paper feeding is started to minimize the decrease in throughput.

Figures 24, 24A:
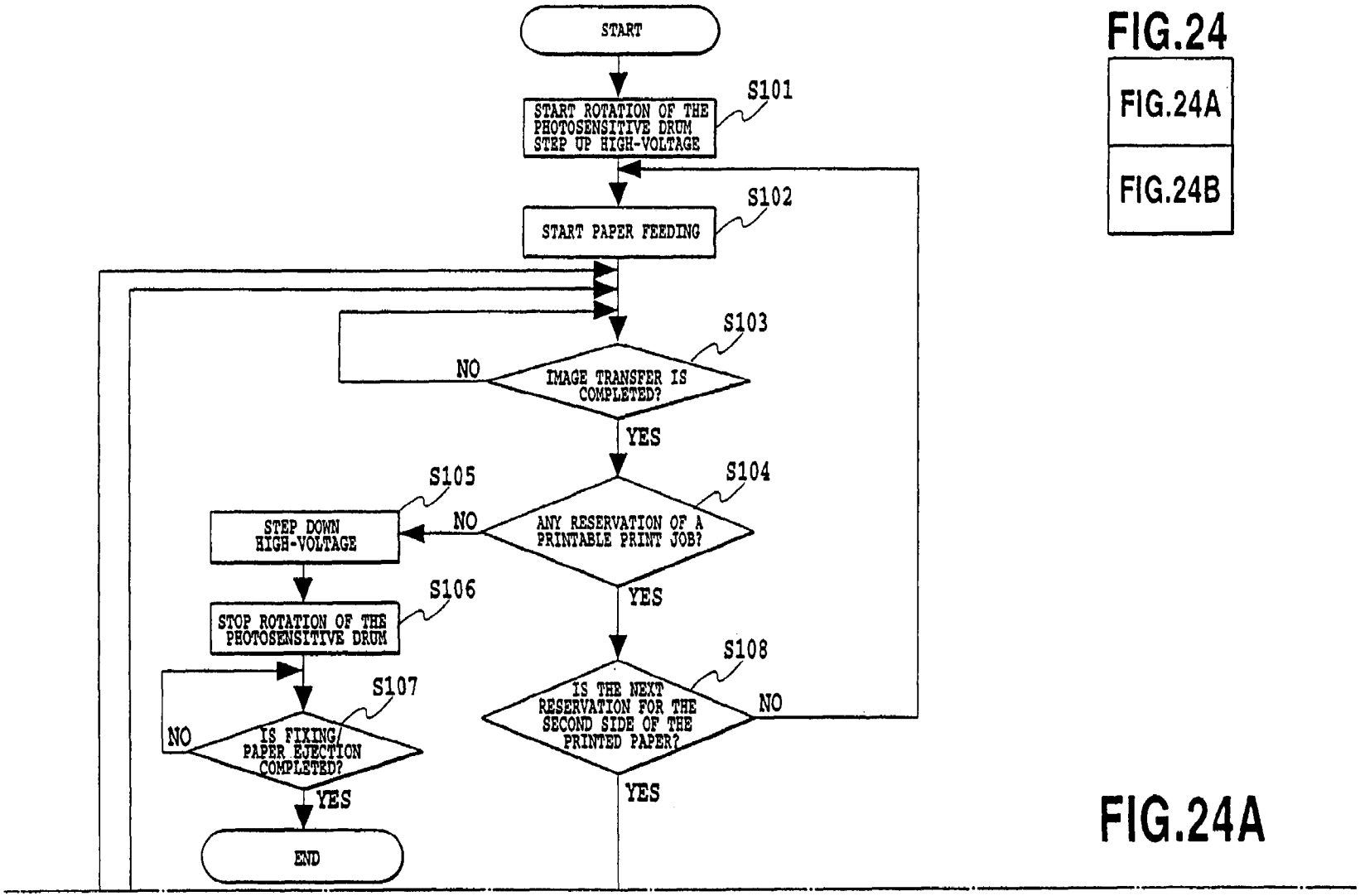
FIG. 24 is a flowchart showing the relationship of FIGS. 24A and 24B.
FIG. 24A is a flowchart (No. 1) illustrating the printing operation of the engine controller of the image forming apparatus of the fifth embodiment.
Figure 24B:
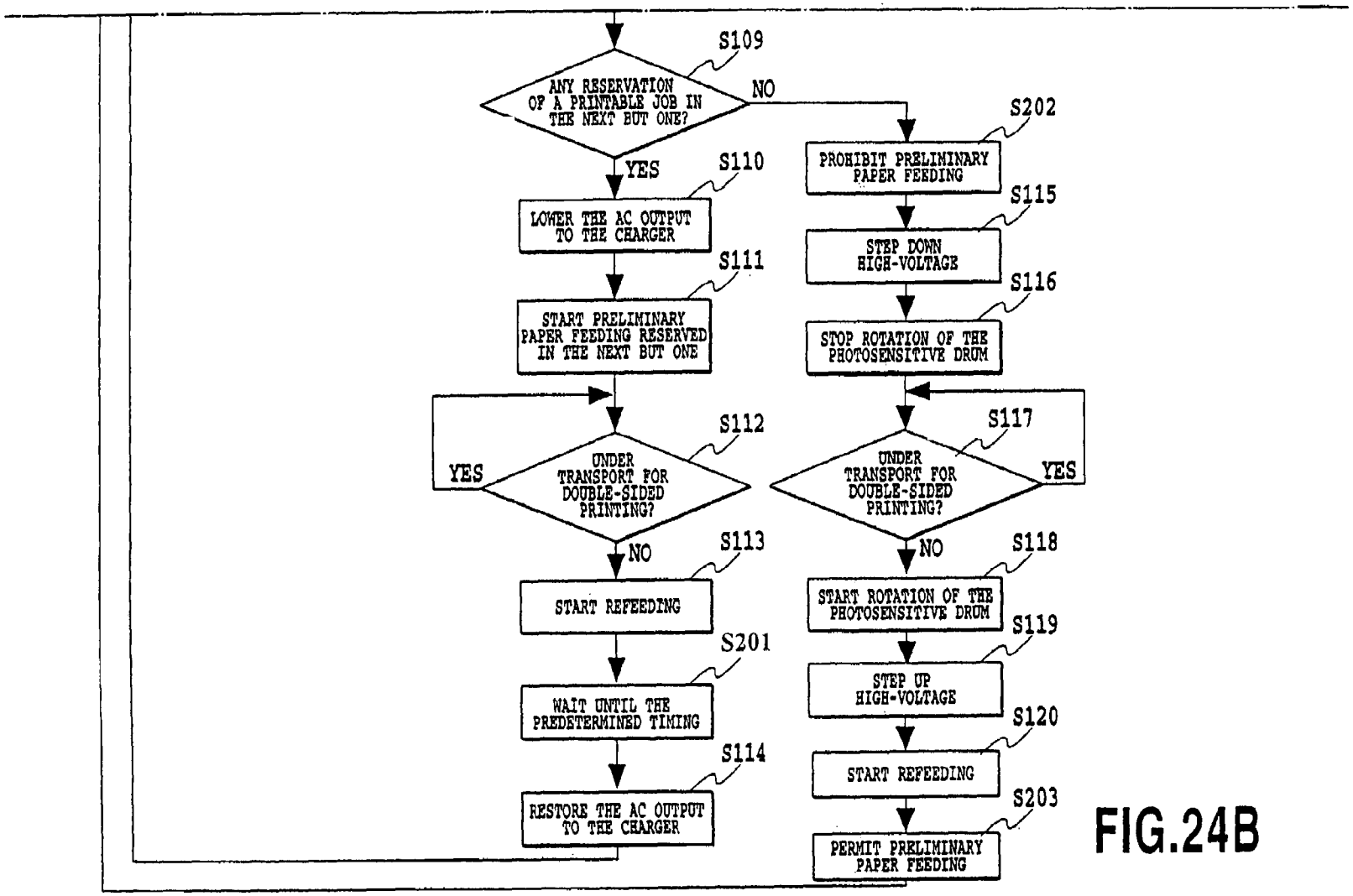
FIG. 24B is a flowchart (No. 2) illustrating the printing operation of the engine controller of the image forming apparatus of the fifth embodiment.

FIGS. 24A and 24B are a flowchart illustrating the steps of printing in the engine controller in the image forming apparatus of the fifth embodiment. The figure focuses on paper feeding and image formation in the printing operation. The same numbers are given to the similar steps in FIGS. 24A–24B and FIGS. 19A–19B for the fourth embodiment, and their explanation is not repeated. The differences between FIGS. 19A–19B and FIGS. 24A–24B are three steps S201, S202 and S203. First, step S201 is explained.

When transport in the turn-over mechanism is ended (step S112), the sheet that has been transported to the position of re-feeding is re-fed for printing on its second side (step S113). In a predetermined time (step S201), the charging AC high-voltage Vcac is restored (step S114). An image is formed on the second side, and the process returns to step S103. Compared with the first embodiment, the time of low output leading to less wear of the photosensitive drum 215 is extended in this embodiment by restoring the output of the charging AC high-voltage Vcac after a certain period of time. If this period of time is set to the time for step-up of the charging AC high-voltage Vcac, the wear of the photosensitive drum 215 is prevented effectively.

Next described are steps S202, S203. Unless a printable print job is reserved in the next but one at step S109, preliminary paper feeding is prohibited (step S202), the high-voltages are stepped down (high-voltages for development and image transfer are terminated and then both the charging DC high-voltage Vcdc and the charging AC high-voltage Vcac are terminated) (step S115), and the rotation of the photosensitive drum 215 is stopped (step S116). Then the first side image of the sheet is fixed, and the sheet is turned over and transported to the position for double-sided printing (step S117). When such paper transport is completed, the rotation of the photosensitive drum 215 is resumed (step S118), and the high-voltages are stepped up (both the charging AC high-voltage Vcac and the charging DC high-voltage Vcdc are provided and then the DC high-voltage Vdc for development is provided) (step S119). The sheet transported to the position for re-feeding is now re-fed for printing on the second side (step S120), and preliminary paper feeding is permitted (step S203). An image is formed on the second side, and the process returns to step S103.

In this manner, preliminary paper feeding is prohibited during the time while the rotation of the photosensitive drum 215 is stopped and therefore the feeder roller is not operable, while preliminary paper feeding is permitted when the rotation of the photosensitive drum 215 is resumed. Then it becomes possible to prevent detecting a paper jam error when preliminary paper feeding is initiated during the time while it is prohibited.

As described so far, in the fifth embodiment compared with the fourth embodiment, the wear of the drum is prevented by extending the period of time of terminating the output of the charging AC high-voltage Vcac. Furthermore, to prevent photosensitive drum 215 wear, preliminary paper feeding is prohibited while the rotation of the photosensitive drum 215 is stopped. If a print reservation is received during such period, preliminary paper feeding is suspended until the rotation of the photosensitive drum 215 is resumed. Then it becomes possible to prevent photosensitive drum 215 wear without error detection of a paper jam while maximizing throughput.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. An image forming apparatus having a double-sided print mode, comprising:

charging means for charging an image carrier;

charge voltage loading means for applying a charge voltage to said charging means;

image forming means for forming an image on a recording material; and control means for controlling the charge voltage applied by said charge voltage loading means to said charging means, wherein, when an image is formed on both sides of a plurality of recording materials, said control means changes the charge voltage during an interval in which an image is formed on a first side and a second side of the recording material by said image forming means to a second charge voltage which is different from a first charge voltage applied by said charge voltage loading means in a period in which an image is formed on the recording material, and said control means does not change the charge voltage during an interval between a first recording material and a second recording material of the plurality of recording materials to the second charge voltage.

2. The image forming apparatus according to claim 1, wherein the double-sided print mode is a mode of transporting the recording material so as to print the plurality of recording materials in a double-sided manner on a one-by-one recording material basis.

3. The image forming apparatus according to claim 1, wherein said control means sets the second charge voltage to a voltage level which is lower than the first charge voltage.

4. The image forming apparatus according to claim 1, further comprising a turn-over transport unit for turning over the recording material and transporting the turned-over recording material to said image forming means, wherein, when the recording material turned over by said turn-over transport unit is transported to a predetermined position before the recording material reaches said image forming means, the charge voltage is switched.

5. The image forming apparatus according to claim 1, wherein said image forming means includes image transfer means for transferring an image formed on the image carrier onto the recording material.

6. The image forming apparatus according to claim 1, wherein the charge voltage includes an AC charge voltage.

7. The image forming apparatus according to claim 6, wherein the charge voltage includes a voltage obtained by adding a DC charge voltage to the AC charge voltage.

8. A printer having a double-sided print mode, comprising:

a charging portion configured and positioned to charge an image carrier;

a charge voltage loading unit configured and positioned to apply a charge voltage to said charging portion;

an image forming portion configured and positioned to form an image on a recording material; and a controller configured and positioned to control the charge voltage applied by said charge voltage loading unit to said charging portion, wherein, when an image is formed on both sides of a plurality of recording materials, said controller changes the charge voltage during an interval in which an image is formed on a first side and a second side of the recording material by said image forming portion to a second charge voltage which is different from a first charge voltage applied by said charge voltage loading unit in a period in which an image is formed on the recording material, and the controller does not change the charge voltage during an interval between a first recording material and a second recording material of the plurality of recording materials to the second charge voltage.

* * * * *

UNITED STATES PATENT AND TRADEMARK OFFICE

CERTIFICATE OF CORRECTION

PATENT NO. : 7,203,435 B2
APPLICATION NO. : 11/377374
DATED : April 10, 2007
INVENTOR(S) : Mitsuhiro Ito et al.

It is certified that error appears in the above-identified patent and that said Letters Patent is hereby corrected as shown below:

COLUMN 1:
Line 25, “electrographic” should read --electrophotographic--.
Line 32, “564” should be deleted.

COLUMN 3:
Line 15, “re-feed it” should read --re-fed--.

COLUMN 10:
Line 34, “V132-(Rs×Imean)+Vt (Eq. 1)” should read --V1=-(Rs×Imean)+Vt (Eq. 1)--.

COLUMN 12:
Line 35, “becomes” should read --become--.
Line 39, “increases” should read --increase--.

COLUMN 15:
Line 3, “of” should be deleted.
Line 5, “surface makes” should read --surface that makes--.
Line 12, “lowing” should read --lowering--.

COLUMN 25:
Line 21, “FIG. 201,” should read --FIG. 20I,--.
Line 52, “FIG. 221” should read --FIG. 22I--.

UNITED STATES PATENT AND TRADEMARK OFFICE

CERTIFICATE OF CORRECTION

PATENT NO. : 7,203,435 B2
APPLICATION NO. : 11/377374
DATED : April 10, 2007
INVENTOR(S) : Mitsuhiro Ito et al.

It is certified that error appears in the above-identified patent and that said Letters Patent is hereby corrected as shown below:

COLUMN 26:
Line 2, "(ID-14," should read --ID=14,--.
Line 11, "FIG. 221," should read --FIG. 22I,--, and "ID-14" should read --ID=14--.
Line 36, "ID-7" should read --ID=7--.

Signed and Sealed this

Sixth Day of May, 2008

JON W. DUDAS
*Director of the United States Patent and Trademark Office*